US011524384B2

(12) United States Patent
Chockalingam et al.

(10) Patent No.: US 11,524,384 B2
(45) Date of Patent: Dec. 13, 2022

(54) ABRASIVE DELIVERY POLISHING PADS AND MANUFACTURING METHODS THEREOF

(71) Applicant: Applied Materials, Inc., Santa Clara, CA (US)

(72) Inventors: Ashwin Chockalingam, Santa Clara, CA (US); Rajeev Bajaj, Fremont, CA (US); Ashavani Kumar, Sunnyvale, CA (US); Daniel Redfield, Morgan Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1073 days.

(21) Appl. No.: 16/048,574

(22) Filed: Jul. 30, 2018

(65) Prior Publication Data

US 2019/0039204 A1 Feb. 7, 2019

Related U.S. Application Data

(60) Provisional application No. 62/542,136, filed on Aug. 7, 2017.

(51) Int. Cl.
*B24B 37/26* (2012.01)
*B24B 37/24* (2012.01)
(Continued)

(52) U.S. Cl.
CPC ..... *B24B 37/26* (2013.01); *B24B 37/245* (2013.01); *B24D 3/20* (2013.01); *B24D 3/28* (2013.01);
(Continued)

(58) Field of Classification Search
CPC ..... B24B 37/24; B24B 37/245; B24D 3/20; B24D 3/28; B24D 3/346
See application file for complete search history.

(56) References Cited

U.S. PATENT DOCUMENTS 2,001,911 A 5/1935 Wooddell et al.
3,357,598 A 12/1967 Kraft
(Continued)

FOREIGN PATENT DOCUMENTS

CN 1441017 A 9/2003
CN 1851896 A 10/2006
(Continued)

OTHER PUBLICATIONS

Pan, GuoShun et al.—"Preparation of silane modified SiO2 abrasive particles and their Chemical Mechanical Polishing (CMP) performances," Wear 273 (2011), pp. 100-104.
(Continued)

*Primary Examiner* — Pegah Parvini
(74) *Attorney, Agent, or Firm* — Patterson + Sheridan, LLP

(57) ABSTRACT

Embodiments of the present disclosure provide for abrasive delivery (AD) polishing pads and manufacturing methods thereof. In one embodiment, a method of forming a polishing article includes forming a sub-polishing element from a first curable resin precursor composition and forming a plurality of polishing elements extending from the sub-polishing element. Forming the plurality of polishing elements includes forming a continuous polymer phase from a second curable resin precursor composition and forming a plurality of discontinuous abrasive delivery features disposed within the continuous polymer phase. The sub-polishing element is formed by dispensing a first plurality of droplets of the first curable resin precursor composition. The plurality polishing elements are formed by dispensing a second plurality of droplets of the second curable resin precursor composition. In some embodiments, the discontinuous abrasive delivery features comprise a water soluble material having abrasive particles interspersed therein.

13 Claims, 9 Drawing Sheets

(51) Int. Cl.

| | |
|---|---|
| ***B24D 3/34*** | (2006.01) |
| ***B24D 11/04*** | (2006.01) |
| ***B24D 3/20*** | (2006.01) |
| ***B24D 3/28*** | (2006.01) |
| ***B24D 11/00*** | (2006.01) |

(52) U.S. Cl.

CPC ..... *B24D 3/346* (2013.01); *B24D 11/001* (2013.01); *B24D 11/04* (2013.01); *B24D 2203/00* (2013.01)

(56) References Cited

U.S. PATENT DOCUMENTS 3,741,116 A 6/1973 Green et al.
4,459,779 A 7/1984 Shen
4,575,330 A 3/1986 Hull
4,836,832 A 6/1989 Tumey et al.
4,841,680 A 6/1989 Hoffstein et al.
4,844,144 A 7/1989 Murphy et al.
4,942,001 A 7/1990 Murphy et al.
4,960,673 A 10/1990 Beck et al.
5,096,530 A 3/1992 Cohen
5,120,476 A 6/1992 Scholz
5,121,329 A 6/1992 Crump
5,178,646 A 1/1993 Barber, Jr. et al.
5,193,316 A 3/1993 Olmstead
5,212,910 A 5/1993 Breivogel et al.
5,287,663 A 2/1994 Pierce et al.
5,300,417 A 4/1994 Lushington et al.
5,378,527 A 1/1995 Nakanishi et al.
5,387,380 A 2/1995 Cima et al.
5,470,368 A 11/1995 Culler
5,533,923 A 7/1996 Shamouilian et al.
5,605,499 A 2/1997 Sugiyama et al.
5,605,760 A 2/1997 Roberts
5,609,517 A 3/1997 Lofaro
5,624,303 A 4/1997 Robinson
5,626,919 A 5/1997 Chapman et al.
5,645,471 A 7/1997 Strecker
5,664,986 A 9/1997 Roh
5,690,540 A 11/1997 Elliott et al.
5,738,574 A 4/1998 Tolles et al.
5,778,481 A 7/1998 Amsden et al.
5,795,218 A 8/1998 Doan et al.
5,876,268 A 3/1999 Lamphere et al.
5,876,490 A 3/1999 Ronay
5,888,121 A 3/1999 Kirchner et al.
5,900,164 A 5/1999 Budinger et al.
5,905,099 A 5/1999 Everaerts et al.
5,906,863 A 5/1999 Lombardi et al.
5,910,471 A 6/1999 Christianson et al.
5,919,082 A 7/1999 Walker et al.
5,921,855 A 7/1999 Dsterheld et al.
5,932,040 A 8/1999 Audisio
5,932,290 A 8/1999 Lombardi et al.
5,940,674 A 8/1999 Sachs et al.
5,944,583 A 8/1999 Cruz et al.
5,951,380 A 9/1999 Kim
5,965,460 A 10/1999 Rach et al.
5,976,000 A 11/1999 Hudson
5,984,769 A 11/1999 Bennett et al.
5,989,111 A 11/1999 Lamphere et al.
5,989,470 A 11/1999 Doan et al.
6,017,609 A 1/2000 Akamatsu et al.
6,022,264 A 2/2000 Cook et al.
6,029,096 A 2/2000 Manners et al.
6,036,579 A 3/2000 Cook et al.
6,062,968 A 5/2000 Sevilla et al.
6,077,581 A 6/2000 Kuramochi et al.
6,090,475 A 7/2000 Robinson et al.
6,095,902 A 8/2000 Reinhardt
6,117,000 A 9/2000 Anjur et al.
6,121,143 A 9/2000 Messner et al.
6,122,564 A 9/2000 Koch et al.
6,126,532 A 10/2000 Sevilla et al.
6,155,910 A 12/2000 Lamphere et al.
6,176,992 B1 1/2001 Talieh
6,206,759 B1 3/2001 Agarwal et al.
6,210,254 B1 4/2001 Cook et al.
6,213,845 B1 4/2001 Elledge
6,228,133 B1 5/2001 Thurber et al.
6,231,629 B1 5/2001 Christianson et al.
6,231,942 B1 5/2001 Blizard et al.
6,241,596 B1 6/2001 Osterheld et al.
6,254,460 B1 7/2001 Walker et al.
6,257,973 B1 7/2001 Fernand Guiselin
6,267,641 B1 7/2001 Vanell et al.
6,273,806 B1 8/2001 Bennett et al.
6,309,276 B1 10/2001 Tsai et al.
6,309,282 B1 10/2001 Wright et al.
6,319,108 B1 11/2001 Adefris et al.
6,322,728 B1 11/2001 Brodkin et al.
6,325,706 B1 12/2001 Krusell et al.
6,328,634 B1 12/2001 Shen et al.
6,332,832 B1 12/2001 Suzuki
6,338,901 B1 1/2002 Veerasamy
6,361,411 B1 3/2002 Chopra et al.
6,361,832 B1 3/2002 Agarwal et al.
6,368,184 B1 4/2002 Beckage
6,390,890 B1 5/2002 Molnar
6,398,466 B1 6/2002 Wheeler et al.
6,399,501 B2 6/2002 Birang et al.
6,402,604 B2 6/2002 Guiselin
6,423,255 B1 7/2002 Hoechsmann et al.
6,428,586 B1 8/2002 Yancey
6,454,634 B1 9/2002 James et al.
6,477,926 B1 11/2002 Swisher et al.
6,488,570 B1 12/2002 James et al.
6,500,053 B2 12/2002 James et al.
6,506,097 B1 1/2003 Adams et al.
6,518,162 B2 2/2003 Ono et al.
6,520,834 B1 2/2003 Marshall
6,520,847 B2 2/2003 Osterheld et al.
6,544,373 B2 4/2003 Chen et al.
6,548,407 B1 4/2003 Chopra et al.
6,569,373 B2 5/2003 Napadensky
6,582,283 B2 6/2003 James et al.
6,585,563 B1 7/2003 Redeker et al.
6,586,494 B2 7/2003 Mejiritski et al.
6,592,443 B1 7/2003 Kramer et al.
6,641,463 B1 11/2003 Molnar
6,641,471 B1 11/2003 Pinheiro et al.
6,645,061 B1 11/2003 Bennett et al.
6,682,402 B1 1/2004 Roberts et al.
6,684,704 B1 2/2004 Obeng
6,685,548 B2 2/2004 Chen et al.
6,692,338 B1 2/2004 Kirchner
6,699,115 B2 3/2004 Osterheld et al.
6,719,818 B1 4/2004 Birang et al.
6,736,709 B1 5/2004 James et al.
6,736,714 B2 5/2004 Dudovicz
6,746,225 B1 6/2004 McHugh
6,746,311 B1 6/2004 Kessel
6,749,485 B1 6/2004 James et al.
6,749,714 B1 6/2004 Ishikawa et al.
6,773,474 B2 8/2004 Koehnle et al.
6,773,475 B2 * 8/2004 Ohishi ..... B24D 3/28 51/293
6,783,436 B1 8/2004 Muldowney
6,790,883 B2 9/2004 Ogawa et al.
6,796,880 B2 9/2004 Redeker et al.
6,811,680 B2 11/2004 Chen et al.
6,811,937 B2 11/2004 Lawton
6,815,570 B1 11/2004 Negiz et al.
6,833,046 B2 12/2004 Wright
6,838,149 B2 1/2005 Lugg
6,840,843 B2 1/2005 Jones et al.
6,843,711 B1 1/2005 Muldowney
6,847,014 B1 1/2005 Benjamin et al.
6,855,588 B1 2/2005 Liao et al.
6,860,793 B2 3/2005 Budinger et al.
6,860,802 B1 3/2005 Vishwanathan et al.
6,866,807 B2 3/2005 Comb et al.
6,869,350 B2 3/2005 Roberts et al.

(56) References Cited

U.S. PATENT DOCUMENTS

| | | | |
|---|---|---|---|
| 6,875,096 | B2 | 4/2005 | Park et al. |
| 6,875,097 | B2 | 4/2005 | Grunwald |
| 6,887,137 | B2 | 5/2005 | Lee et al. |
| 6,896,593 | B2 | 5/2005 | Prasad |
| 6,913,517 | B2 | 7/2005 | Prasad |
| 6,935,931 | B2 | 8/2005 | Prasad |
| 6,955,588 | B1 | 10/2005 | Anderson, II et al. |
| 6,984,163 | B2 | 1/2006 | Roberts |
| 6,991,517 | B2 | 1/2006 | Redeker et al. |
| 6,991,528 | B2 | 1/2006 | Hu et al. |
| 6,998,166 | B2 | 2/2006 | Prasad |
| 7,018,560 | B2 | 3/2006 | Liu et al. |
| 7,029,747 | B2 | 4/2006 | Huh et al. |
| 7,044,836 | B2 | 5/2006 | Sun et al. |
| 7,059,949 | B1 | 6/2006 | Elmufdi et al. |
| 7,059,950 | B1 | 6/2006 | Muldowney |
| 7,077,879 | B2 | 7/2006 | Ogawa et al. |
| 7,120,512 | B2 | 10/2006 | Kramer et al. |
| 7,125,318 | B2 | 10/2006 | Muldowney |
| 7,132,033 | B2 | 11/2006 | Boldizar et al. |
| 7,166,017 | B2 | 1/2007 | Minamihaba et al. |
| 7,169,030 | B1 | 1/2007 | Kulp |
| 7,186,164 | B2 | 3/2007 | Manens |
| 7,186,322 | B2 | 3/2007 | Sato et al. |
| 7,192,336 | B2 | 3/2007 | Kramer et al. |
| 7,195,544 | B2 | 3/2007 | Prasad |
| 7,204,742 | B2 | 4/2007 | Prasad |
| 7,234,224 | B1 | 6/2007 | Naugler et al. |
| 7,252,871 | B2 | 8/2007 | Crkvenac et al. |
| 7,264,641 | B2 | 9/2007 | Prasad |
| 7,267,607 | B2 | 9/2007 | Prasad |
| 7,267,610 | B1 | 9/2007 | Elmufdi et al. |
| 7,268,173 | B2 | 9/2007 | Graichen et al. |
| 7,300,340 | B1 | 11/2007 | Elmufdi et al. |
| 7,300,619 | B2 | 11/2007 | Napadensky et al. |
| 7,311,590 | B1 | 12/2007 | Muldowney |
| 7,311,862 | B2 | 12/2007 | Prasad |
| 7,332,104 | B2 | 2/2008 | Minamihaba et al. |
| 7,357,698 | B2 | 4/2008 | Choi |
| 7,371,160 | B1 | 5/2008 | Cruz |
| 7,377,840 | B2 | 5/2008 | Deopura et al. |
| 7,382,959 | B1 | 6/2008 | Jacobsen |
| 7,425,172 | B2 | 9/2008 | Misra et al. |
| 7,425,250 | B2 | 9/2008 | Basol et al. |
| 7,427,340 | B2 | 9/2008 | Mavliev et al. |
| 7,435,161 | B2 | 10/2008 | Prasad et al. |
| 7,435,165 | B2 | 10/2008 | Prasad |
| 7,438,636 | B2 | 10/2008 | Kulp et al. |
| 7,438,795 | B2 | 10/2008 | Wylie et al. |
| 7,445,847 | B2 | 11/2008 | Kulp |
| 7,455,571 | B1 | 11/2008 | Kuo et al. |
| 7,497,885 | B2 | 3/2009 | Kollodge |
| 7,513,818 | B2 | 4/2009 | Miller et al. |
| 7,517,277 | B2 | 4/2009 | Muldowney |
| 7,517,488 | B2 | 4/2009 | Saikin |
| 7,520,798 | B2 | 4/2009 | Muldowney |
| 7,524,345 | B2 | 4/2009 | Nevoret et al. |
| 7,530,880 | B2 | 5/2009 | Bajaj et al. |
| 7,531,117 | B2 | 5/2009 | Ederer et al. |
| 7,537,446 | B2 | 5/2009 | James et al. |
| 7,582,127 | B2 | 9/2009 | Vacassy et al. |
| 7,635,290 | B2 | 12/2009 | Muldowney |
| 7,648,645 | B2 | 1/2010 | Roberts et al. |
| 7,652,286 | B2 | 1/2010 | Isobe et al. |
| 7,699,684 | B2 | 4/2010 | Prasad |
| 7,704,122 | B2 | 4/2010 | Misra et al. |
| 7,704,125 | B2 | 4/2010 | Roy et al. |
| 7,731,568 | B2 | 6/2010 | Shimomura et al. |
| 7,754,118 | B2 | 7/2010 | Huh et al. |
| 7,762,870 | B2 | 7/2010 | Ono et al. |
| 7,815,778 | B2 | 10/2010 | Bajaj |
| 7,828,634 | B2 | 11/2010 | Jiang et al. |
| 7,840,305 | B2 | 11/2010 | Behr et al. |
| 7,846,008 | B2 | 12/2010 | Bajaj |
| 7,871,309 | B2 | 1/2011 | Ogawa et al. |
| 7,875,091 | B2 | 1/2011 | Nevoret et al. |
| 7,926,521 | B2 | 4/2011 | Izumoto et al. |
| 7,935,276 | B2 | 5/2011 | Zhou et al. |
| 7,943,681 | B2 | 5/2011 | Lee et al. |
| 7,976,901 | B2 | 7/2011 | Kume et al. |
| 8,047,899 | B2 | 11/2011 | Chen et al. |
| 8,053,487 | B2 | 11/2011 | Ragain, Jr. et al. |
| 8,057,282 | B2 | 11/2011 | Muldowney |
| 8,062,102 | B2 | 11/2011 | Park et al. |
| 8,062,103 | B2 | 11/2011 | Muldowney |
| 8,066,555 | B2 | 11/2011 | Bajaj |
| 8,067,814 | B2 | 11/2011 | Takehara et al. |
| 8,075,372 | B2 | 12/2011 | Prasad |
| 8,075,745 | B2 | 12/2011 | Bajaj |
| 8,083,820 | B2 | 12/2011 | Kollodge et al. |
| 8,111,603 | B2 | 2/2012 | Nishimura et al. |
| 8,118,641 | B2 | 2/2012 | Kulp et al. |
| 8,142,860 | B2 | 3/2012 | Vanmaele et al. |
| 8,142,869 | B2 | 3/2012 | Kobayashi et al. |
| 8,172,648 | B2 | 5/2012 | Lefevre et al. |
| 8,177,603 | B2 | 5/2012 | Bajaj |
| 8,211,543 | B2 | 7/2012 | Kato et al. |
| 8,257,545 | B2 | 9/2012 | Loyack et al. |
| 8,260,447 | B2 | 9/2012 | Mattes et al. |
| 8,282,866 | B2 | 10/2012 | Hiraide |
| 8,287,793 | B2 | 10/2012 | Deopura et al. |
| 8,288,448 | B2 | 10/2012 | Kulp |
| 8,292,592 | B2 | 10/2012 | Welch et al. |
| 8,292,692 | B2 | 10/2012 | Bajaj |
| 8,337,282 | B2 | 12/2012 | Park et al. |
| 8,349,706 | B2 | 1/2013 | Noda |
| 8,377,623 | B2 | 2/2013 | Fong |
| 8,380,339 | B2 | 2/2013 | Misra et al. |
| 8,393,934 | B2 | 3/2013 | Sung |
| 8,398,461 | B2 | 3/2013 | Wang |
| 8,409,976 | B2 | 4/2013 | Hieslmair |
| 8,444,890 | B2 | 5/2013 | Drury |
| 8,545,292 | B2 | 10/2013 | Shinchi et al. |
| 8,546,717 | B2 | 10/2013 | Stecker |
| 8,562,389 | B2 | 10/2013 | Benvegnu et al. |
| 8,598,523 | B2 | 12/2013 | Stecker et al. |
| 8,602,851 | B2 | 12/2013 | Lombardo et al. |
| 8,647,179 | B2 | 2/2014 | Nakayama et al. |
| 8,684,794 | B2 | 4/2014 | Lefevre et al. |
| 8,690,978 | B2 | 4/2014 | Amaud et al. |
| 8,702,479 | B2 | 4/2014 | Huang et al. |
| 8,709,114 | B2 | 4/2014 | Cantrell et al. |
| 8,715,035 | B2 | 5/2014 | Roy et al. |
| 8,734,206 | B2 | 5/2014 | Chang et al. |
| 8,784,721 | B2 | 7/2014 | Philippi et al. |
| 8,801,949 | B2 | 8/2014 | Lakrout et al. |
| 8,821,214 | B2 | 9/2014 | Joseph |
| 8,845,852 | B2 | 9/2014 | Nakamori et al. |
| 8,853,082 | B2 | 10/2014 | Hanano et al. |
| 8,853,527 | B2 | 10/2014 | Hieslmair |
| 8,864,859 | B2 | 10/2014 | Roy et al. |
| 8,883,392 | B2 | 11/2014 | Napadensky et al. |
| 8,888,480 | B2 | 11/2014 | Yoo et al. |
| 8,894,799 | B2 | 11/2014 | Lakrout |
| 8,932,116 | B2 | 1/2015 | Deopura et al. |
| 8,932,511 | B2 | 1/2015 | Napadensky |
| 8,968,058 | B2 | 3/2015 | Kerprich et al. |
| 8,980,749 | B1 | 3/2015 | Itai et al. |
| 8,986,585 | B2 | 3/2015 | Cantrell et al. |
| 9,017,140 | B2 | 4/2015 | Allison et al. |
| 9,033,764 | B2 | 5/2015 | Kitamura et al. |
| 9,067,297 | B2 | 6/2015 | Allison et al. |
| 9,067,298 | B2 | 6/2015 | Lefevre et al. |
| 9,067,299 | B2 | 6/2015 | Bajaj et al. |
| 9,068,085 | B2 | 6/2015 | Kim et al. |
| 9,089,943 | B2 | 7/2015 | Lipson |
| 9,108,291 | B2 | 8/2015 | Lakrout |
| 9,126,304 | B2 | 9/2015 | Kimura |
| 9,138,858 | B2 | 9/2015 | Benvegnu et al. |
| 9,152,006 | B2 | 10/2015 | Farrand et al. |
| 9,152,340 | B2 | 10/2015 | Wu et al. |
| 9,156,124 | B2 | 10/2015 | Allison et al. |
| 9,162,340 | B2 | 10/2015 | Joseph et al. |
| 9,162,341 | B2 | 10/2015 | LeFevre et al. |

(56) References Cited

U.S. PATENT DOCUMENTS 9,211,628 B2 12/2015 Allison et al.
9,216,546 B2 12/2015 DeSimone et al.
9,254,545 B2 2/2016 Park
9,259,820 B2 2/2016 Qian et al.
9,259,821 B2 2/2016 Qian et al.
9,278,424 B2 3/2016 Roy et al.
9,296,085 B2 3/2016 Bajaj et al.
9,308,620 B2 4/2016 Schutte et al.
9,314,897 B2 4/2016 Qian et al.
9,333,620 B2 5/2016 Qian et al.
9,352,443 B2 5/2016 Suen et al.
9,375,821 B2 6/2016 Chen et al.
9,375,822 B2 6/2016 Hsu et al.
9,393,740 B2 7/2016 Okamoto et al.
9,421,666 B2 8/2016 Krishnan et al.
9,457,520 B2 10/2016 Bajaj et al.
9,469,800 B2 10/2016 Jung
9,481,069 B2 11/2016 Chen et al.
9,505,952 B2 11/2016 Reiss et al.
9,587,127 B2 3/2017 Herlihy et al.
9,630,249 B2 4/2017 Toyserkani et al.
9,669,512 B2 6/2017 Bajaj et al.
9,718,129 B2 8/2017 Ljungblad et al.
9,744,724 B2 8/2017 Bajaj et al.
9,776,361 B2 10/2017 Krishnan et al.
9,868,230 B2 1/2018 Dikovsky et al.
9,873,180 B2 1/2018 Bajaj et al.
9,950,405 B2 4/2018 Deng
9,951,054 B2 4/2018 Li et al.
9,956,314 B2 5/2018 Skaria et al.
9,993,907 B2 6/2018 Murugesh et al.
10,005,236 B2 6/2018 Yudovin-Farber et al.
10,016,877 B2 7/2018 Krishnan et al.
10,029,405 B2 7/2018 Bajaj et al.
10,086,500 B2 10/2018 Orilall et al.
10,220,487 B2 3/2019 Roy et al.
10,245,704 B2 4/2019 Eilers et al.
10,322,491 B2 6/2019 Orilall et al.
10,335,994 B2 7/2019 Napadensky et al.
10,384,330 B2 8/2019 Bajaj et al.
10,391,605 B2 8/2019 Ganapathiappan et al.
10,399,201 B2 9/2019 Ganapathiappan et al.
10,406,599 B2 9/2019 Ljungblad et al.
10,406,801 B2 9/2019 Bell et al.
10,456,886 B2 10/2019 Ganapathiappan et al.
10,483,235 B2 11/2019 Chiao et al.
10,493,691 B2 12/2019 Krishnan et al.
10,537,974 B2 1/2020 Bajaj et al.
10,593,574 B2 3/2020 Fung et al.
10,618,141 B2 4/2020 Chockalingam et al.
10,675,789 B2 6/2020 Dikovsky et al.
10,744,714 B2 8/2020 Lopez et al.
10,773,509 B2 9/2020 Ng et al.
10,821,573 B2 11/2020 Bajaj et al.
10,875,145 B2 12/2020 Bajaj et al.
10,875,153 B2 12/2020 Bajaj et al.
10,876,073 B2 12/2020 Ishida
10,919,123 B2 2/2021 Hariharan et al.
10,953,515 B2 3/2021 Ganapathiappan et al.
2001/0008830 A1 7/2001 Tolles et al.
2001/0020448 A1 9/2001 Vaartstra et al.
2001/0029151 A1 10/2001 Chopra
2001/0034089 A1 10/2001 Yamazaki et al.
2001/0041511 A1 11/2001 Lack et al.
2001/0046834 A1 11/2001 Ramana et al.
2002/0016139 A1 2/2002 Hirokawa et al.
2002/0058468 A1 5/2002 Eppert et al.
2002/0069591 A1 6/2002 Yancey
2002/0077036 A1 6/2002 Roberts et al.
2002/0083577 A1 7/2002 Suzuki
2002/0112632 A1 8/2002 Faibish
2002/0137450 A1 9/2002 Osterheld et al.
2002/0173248 A1 11/2002 Doan et al.
2003/0019570 A1 1/2003 Chen et al.
2003/0022611 A1 1/2003 Bartlett et al.
2003/0056870 A1 3/2003 Comb et al.
2003/0113509 A1 6/2003 Lugg
2003/0134581 A1 7/2003 Wang et al.
2003/0153253 A1 8/2003 Hanamoto et al.
2003/0153255 A1 8/2003 Hasegawa et al.
2003/0166381 A1 9/2003 Lee et al.
2003/0181137 A1 9/2003 Redeker et al.
2003/0205325 A1 11/2003 Boyd et al.
2003/0220061 A1 11/2003 Prasad
2004/0003895 A1 1/2004 Amano et al.
2004/0014413 A1 1/2004 Kawahashi et al.
2004/0033758 A1 2/2004 Wiswesser
2004/0055223 A1 3/2004 Ono et al.
2004/0058623 A1 3/2004 Lin et al.
2004/0092108 A1 5/2004 Yajima et al.
2004/0106367 A1 6/2004 Walker et al.
2004/0126575 A1 7/2004 Koshida et al.
2004/0133298 A1 7/2004 Toyserkani et al.
2004/0154533 A1 8/2004 Agarwal et al.
2004/0171340 A1 9/2004 Prasad
2004/0173946 A1 9/2004 Pfeifer et al.
2004/0175451 A1 9/2004 Maekawa et al.
2004/0180611 A1 9/2004 Tajima et al.
2004/0187714 A1 9/2004 Napadensky et al.
2004/0198185 A1 10/2004 Redeker et al.
2004/0224616 A1 11/2004 Shiho et al.
2004/0266326 A1 12/2004 Shiho et al.
2005/0003189 A1 1/2005 Bredt et al.
2005/0016868 A1 1/2005 Basol et al.
2005/0020082 A1 1/2005 Vishwanathan et al.
2005/0032464 A1 2/2005 Swisher et al.
2005/0062900 A1 3/2005 Kim
2005/0086869 A1 4/2005 Park et al.
2005/0098540 A1 5/2005 Prasad
2005/0101228 A1 5/2005 Prasad
2005/0110853 A1 5/2005 Gardner et al.
2005/0112998 A1 5/2005 Matsuo et al.
2005/0124262 A1 6/2005 Manens
2005/0153634 A1 7/2005 Prasad et al.
2005/0171224 A1 8/2005 Kulp
2005/0194681 A1 9/2005 Hu et al.
2005/0215177 A1 9/2005 Prasad
2005/0227590 A1 10/2005 Sung
2005/0250431 A1 11/2005 Shih et al.
2005/0260928 A1 11/2005 Huh et al.
2005/0260939 A1 11/2005 Andrews et al.
2005/0261150 A1 11/2005 Yonker et al.
2005/0274627 A1 12/2005 Wylie et al.
2005/0276967 A1 12/2005 Prasad
2005/0284536 A1 12/2005 Kojima et al.
2006/0019587 A1 1/2006 Deopura et al.
2006/0024434 A1 2/2006 Wang et al.
2006/0052040 A1 3/2006 Prasad
2006/0079159 A1 4/2006 Naujok et al.
2006/0096179 A1 5/2006 Lu et al.
2006/0125133 A1 6/2006 Huh et al.
2006/0160478 A1 7/2006 Donohue et al.
2006/0185256 A1 8/2006 Nevoret et al.
2006/0189269 A1 8/2006 Roy et al.
2006/0192315 A1 8/2006 Farr et al.
2006/0226567 A1 10/2006 James et al.
2006/0252900 A1 11/2006 Bowman et al.
2006/0276109 A1 12/2006 Roy et al.
2007/0007698 A1 1/2007 Sano
2007/0009606 A1 1/2007 Serdy et al.
2007/0032170 A1 2/2007 Halley et al.
2007/0037486 A1 2/2007 Kang et al.
2007/0054599 A1 3/2007 Taylor et al.
2007/0093185 A1 4/2007 Naik
2007/0117393 A1 5/2007 Tregub et al.
2007/0128874 A1 6/2007 Shida et al.
2007/0128991 A1 6/2007 Yoon et al.
2007/0149096 A1 6/2007 Nishimura et al.
2007/0204420 A1 9/2007 Hornby et al.
2007/0212979 A1 9/2007 Preston
2007/0221287 A1 9/2007 Izumoto
2007/0235133 A1 10/2007 Benassi
2007/0235904 A1 10/2007 Saikin
2007/0243795 A1 10/2007 Kobayashi et al.

(56) References Cited

U.S. PATENT DOCUMENTS

2007/0269987 A1 11/2007 Nakano et al.
2008/0004743 A1 1/2008 Goers et al.
2008/0009228 A1 1/2008 Nagase et al.
2008/0057845 A1 3/2008 Prasad
2008/0060734 A1 3/2008 Stehle
2008/0105818 A1 5/2008 Cohen
2008/0157436 A1 7/2008 Patel et al.
2008/0207100 A1 8/2008 Roy et al.
2008/0211141 A1 9/2008 Deopura et al.
2008/0220702 A1 9/2008 Feng et al.
2008/0255823 A1 10/2008 Grant
2008/0268760 A1 10/2008 Bajaj et al.
2008/0314878 A1 12/2008 Cai et al.
2009/0011679 A1 1/2009 Bajaj et al.
2009/0053976 A1 2/2009 Roy et al.
2009/0053983 A1 2/2009 Hosaka et al.
2009/0081927 A1 3/2009 Grumbine et al.
2009/0093201 A1 4/2009 Kazuno et al.
2009/0094902 A1 4/2009 Hou
2009/0105363 A1 4/2009 Napadensky
2009/0130956 A1 5/2009 Ohta et al.
2009/0133716 A1 5/2009 Lee
2009/0137121 A1 5/2009 Hsu et al.
2009/0169455 A1 7/2009 Van Aert et al.
2009/0206065 A1 8/2009 Kruth et al.
2009/0253353 A1 10/2009 Ogawa et al.
2009/0270019 A1 10/2009 Bajaj
2009/0308553 A1 12/2009 Souzy et al.
2009/0308739 A1 12/2009 Riker et al.
2009/0311955 A1 12/2009 Kerprich et al.
2009/0320379 A1 12/2009 Jun et al.
2009/0321979 A1 12/2009 Hiraide
2010/0007692 A1 1/2010 Vanmaele et al.
2010/0009612 A1 1/2010 Park et al.
2010/0011672 A1 1/2010 Kincaid et al.
2010/0087128 A1 4/2010 Nakayama et al.
2010/0112919 A1 5/2010 Bonner et al.
2010/0120249 A1 5/2010 Hirose et al.
2010/0120343 A1 5/2010 Kato et al.
2010/0130112 A1 5/2010 Bajaj
2010/0140850 A1 6/2010 Napadensky et al.
2010/0203815 A1 8/2010 Bajaj
2010/0210197 A1 8/2010 Matsumura et al.
2010/0221489 A1 9/2010 Lappalainen et al.
2010/0255254 A1* 10/2010 Culler ..... B24D 11/00 428/143
2010/0323050 A1 12/2010 Kumagai et al.
2011/0011217 A1 1/2011 Kojima
2011/0014858 A1 1/2011 Tsai et al.
2011/0045199 A1 2/2011 Cong
2011/0048772 A1 3/2011 Han
2011/0059247 A1 3/2011 Kuzusako et al.
2011/0077321 A1 3/2011 Napadensky
2011/0130077 A1 6/2011 Litke et al.
2011/0171890 A1 7/2011 Nakayama et al.
2011/0180952 A1 7/2011 Napadensky
2011/0183583 A1 7/2011 Joseph
2011/0204538 A1 8/2011 Drury
2011/0277789 A1 11/2011 Benson
2011/0277877 A1 11/2011 Stehle
2012/0094487 A1 4/2012 Kranz et al.
2012/0178348 A1 7/2012 Hsu et al.
2012/0178845 A1 7/2012 Napadensky et al.
2012/0281334 A1 11/2012 Sasaki et al.
2012/0302148 A1 11/2012 Bajaj et al.
2012/0315830 A1 12/2012 Joseph et al.
2013/0012108 A1 1/2013 Li et al.
2013/0017769 A1 1/2013 Kimura
2013/0019570 A1 1/2013 Weible
2013/0048018 A1 2/2013 Wargo et al.
2013/0052917 A1 2/2013 Park
2013/0055568 A1 3/2013 Dusel et al.
2013/0059506 A1 3/2013 Qian et al.
2013/0059509 A1 3/2013 Deopura et al.
2013/0102231 A1 4/2013 Joseph et al.
2013/0122705 A1 5/2013 Babu et al.
2013/0137350 A1 5/2013 Allison et al.
2013/0139851 A1 6/2013 Sin et al.
2013/0172509 A1 7/2013 Pawloski et al.
2013/0183824 A1 7/2013 Kwon et al.
2013/0212951 A1 8/2013 Ahn et al.
2013/0231032 A1 9/2013 Swedek et al.
2013/0247477 A1 9/2013 Cantrell et al.
2013/0283700 A1 10/2013 Bajaj et al.
2013/0287980 A1 10/2013 Burdzy et al.
2013/0307194 A1 11/2013 Elsey
2013/0309951 A1 11/2013 Benvegnu et al.
2013/0316081 A1 11/2013 Kovalcik et al.
2013/0327977 A1 12/2013 Singh et al.
2013/0328228 A1 12/2013 Pettis et al.
2014/0024216 A1 1/2014 Stender et al.
2014/0034229 A1 2/2014 Xu
2014/0048970 A1 2/2014 Batchelder et al.
2014/0065932 A1 3/2014 Kazuno et al.
2014/0109784 A1 4/2014 Daems et al.
2014/0117575 A1 5/2014 Kemperle et al.
2014/0127973 A1 5/2014 Motoshima et al.
2014/0163717 A1 6/2014 Das et al.
2014/0206268 A1 7/2014 Lefevre et al.
2014/0230170 A1 8/2014 Patel
2014/0239527 A1 8/2014 Lee
2014/0324206 A1 10/2014 Napadensky
2014/0364044 A1 12/2014 Ahn et al.
2014/0370214 A1 12/2014 Araki et al.
2014/0370788 A1 12/2014 Nair
2015/0024233 A1 1/2015 Gunther
2015/0031781 A1 1/2015 Landers et al.
2015/0037601 A1 2/2015 Blackmore
2015/0038066 A1 2/2015 Huang et al.
2015/0043122 A1 2/2015 Eto et al.
2015/0044951 A1 2/2015 Bajaj et al.
2015/0045928 A1 2/2015 Perez et al.
2015/0056421 A1 2/2015 Yudovin-Farber et al.
2015/0056892 A1 2/2015 Vacassy et al.
2015/0056895 A1 2/2015 Fotou et al.
2015/0061170 A1 3/2015 Engel et al.
2015/0065020 A1 3/2015 Roy et al.
2015/0072522 A1 3/2015 Jung
2015/0084238 A1 3/2015 Bonassar et al.
2015/0089881 A1 4/2015 Stevenson et al.
2015/0093977 A1 4/2015 Deopura et al.
2015/0115490 A1 4/2015 Reinarz
2015/0123298 A1 5/2015 Napadensky
2015/0126099 A1 5/2015 Krishnan et al.
2015/0129798 A1 5/2015 Napadensky
2015/0159046 A1 6/2015 Dinega et al.
2015/0174826 A1 6/2015 Murugesh et al.
2015/0216790 A1 8/2015 Feng et al.
2015/0221520 A1 8/2015 Singh et al.
2015/0252202 A1 9/2015 Nerad
2015/0375361 A1 12/2015 Qian et al.
2016/0052103 A1 2/2016 Qian et al.
2016/0068996 A1 3/2016 Lau et al.
2016/0101500 A1 4/2016 Fung et al.
2016/0107287 A1 4/2016 Bajaj et al.
2016/0107288 A1 4/2016 Orilall et al.
2016/0107290 A1* 4/2016 Bajaj ..... B24B 37/22 451/527
2016/0107295 A1 4/2016 Bajaj et al.
2016/0107381 A1 4/2016 Krishnan et al.
2016/0114458 A1 4/2016 Bajaj et al.
2016/0136787 A1 5/2016 Bajaj et al.
2016/0176021 A1 6/2016 Orilall et al.
2016/0221145 A1 8/2016 Huang et al.
2016/0229023 A1 8/2016 Lugg et al.
2016/0236279 A1 8/2016 Ashton et al.
2016/0252813 A1 9/2016 Kitson
2016/0257856 A1 9/2016 Reiss et al.
2016/0271869 A1 9/2016 Van De Vrie et al.
2016/0279757 A1 9/2016 Qian et al.
2016/0346997 A1 12/2016 Lewis et al.
2016/0347002 A1 12/2016 Bajaj et al.
2016/0354901 A1 12/2016 Krishnan et al.
2016/0375546 A1 12/2016 Pai et al.

(56) References Cited

U.S. PATENT DOCUMENTS

| | | | |
|---|---|---|---|
| 2017/0036320 | A1 | 2/2017 | Prasad |
| 2017/0100817 | A1 | 4/2017 | Ganapathiappan et al. |
| 2017/0120416 | A1 | 5/2017 | Chockalingam et al. |
| 2017/0133252 | A1 | 5/2017 | Fung et al. |
| 2017/0136603 | A1 | 5/2017 | Ganapathiappan et al. |
| 2017/0148539 | A1 | 5/2017 | Prestayko et al. |
| 2017/0151648 | A1 | 6/2017 | Huang et al. |
| 2017/0173865 | A1 | 6/2017 | Dikovsky et al. |
| 2017/0182629 | A1 | 6/2017 | Lehuu et al. |
| 2017/0203406 | A1 | 7/2017 | Ganapathiappan et al. |
| 2017/0203408 | A1 | 7/2017 | Ganapathiappan et al. |
| 2017/0203409 | A1 | 7/2017 | Lefevre et al. |
| 2017/0239886 | A1 | 8/2017 | Norikane |
| 2017/0259396 | A1 | 9/2017 | Yamamura et al. |
| 2017/0259499 | A1 | 9/2017 | Ng et al. |
| 2017/0274498 | A1 | 9/2017 | Oh et al. |
| 2018/0043613 | A1 | 2/2018 | Krishnan et al. |
| 2018/0100073 | A1 | 4/2018 | Chopra et al. |
| 2018/0100074 | A1 | 4/2018 | Chopra et al. |
| 2018/0100075 | A1 | 4/2018 | Chopra et al. |
| 2018/0158707 | A1 | 6/2018 | Hunter et al. |
| 2018/0161954 | A1 | 6/2018 | Bajaj et al. |
| 2018/0229343 | A1 | 8/2018 | Kim et al. |
| 2018/0236632 | A1 | 8/2018 | Murugesh et al. |
| 2018/0339397 | A1 | 11/2018 | Redfield |
| 2018/0339402 | A1 | 11/2018 | Redfield et al. |
| 2018/0339447 | A1 | 11/2018 | Redfield |
| 2018/0340104 | A1 | 11/2018 | Hampson et al. |
| 2018/0371276 | A1 | 12/2018 | Miyano |
| 2019/0030678 | A1 | 1/2019 | Kumar et al. |
| 2019/0039204 | A1 | 2/2019 | Chockalingam et al. |
| 2019/0047112 | A1 | 2/2019 | Fu et al. |
| 2019/0202024 | A1 | 7/2019 | Ganapathiappan et al. |
| 2019/0218697 | A1 | 7/2019 | Nakayama et al. |
| 2019/0224809 | A1 | 7/2019 | Ganapathiappan et al. |
| 2019/0299357 | A1 | 10/2019 | Orilall et al. |
| 2019/0299537 | A1 | 10/2019 | McClintock et al. |
| 2019/0337117 | A1 | 11/2019 | Ganapathiappan et al. |
| 2020/0001433 | A1 | 1/2020 | Bajaj et al. |
| 2020/0055161 | A1 | 2/2020 | Chockalingham et al. |
| 2020/0070302 | A1 | 3/2020 | Ganapathiappan et al. |
| 2020/0101657 | A1 | 4/2020 | Krishnan et al. |
| 2020/0135517 | A1 | 4/2020 | Fung et al. |
| 2020/0147750 | A1 | 5/2020 | Bajaj et al. |
| 2020/0156311 | A1 | 5/2020 | Rolland et al. |
| 2020/0230781 | A1 | 7/2020 | Chockalingam et al. |
| 2020/0299834 | A1 | 9/2020 | Bajaj et al. |
| 2020/0325353 | A1 | 10/2020 | Sridhar et al. |
| 2021/0013014 | A1 | 1/2021 | Sarode Vishwanath |
| 2021/0039167 | A1 | 2/2021 | Ashton et al. |
| 2021/0107116 | A1 | 4/2021 | Bajaj et al. |
| 2021/0187822 | A1 | 6/2021 | Yudovin-Farber et al. |
| 2021/0220857 | A1 | 7/2021 | Baker et al. |

FOREIGN PATENT DOCUMENTS

| | | | |
|---|---|---|---|
| CN | 1897226 | A | 1/2007 |
| CN | 101199994 | A | 6/2008 |
| CN | 101428404 | A | 5/2009 |
| CN | 101612722 | A | 12/2009 |
| CN | 201483382 | U | 5/2010 |
| CN | 101642898 | B | 9/2011 |
| CN | 202825512 | U | 3/2013 |
| CN | 203542340 | U | 4/2014 |
| CN | 104210108 | A | 12/2014 |
| CN | 104385595 | A | 3/2015 |
| CN | 104400998 | A | 3/2015 |
| CN | 104607639 | A | 5/2015 |
| CN | 103465155 | B | 5/2016 |
| CN | 106810215 | A | 6/2017 |
| DE | 19834559 | A1 | 2/2000 |
| EP | 1078717 | A2 | 2/2001 |
| EP | 1078717 | A3 | 7/2003 |
| EP | 1419876 | B1 | 4/2008 |
| EP | 2025458 | A2 | 2/2009 |
| EP | 2025459 | A2 | 2/2009 |
| EP | 2277686 | A2 | 1/2011 |
| EP | 2431157 | A1 | 3/2012 |
| EP | 2463082 | A1 | 6/2012 |
| GB | 2362592 | A | 11/2001 |
| JP | H07102724 | B2 | 11/1995 |
| JP | H08132342 | A | 5/1996 |
| JP | 09076353 | A | 3/1997 |
| JP | 11-254542 | A | 9/1999 |
| JP | H11254542 | A | 9/1999 |
| JP | 11-347761 | A | 12/1999 |
| JP | H11347761 | A | 12/1999 |
| JP | 2000061817 | A | 2/2000 |
| JP | 2001018163 | A | 1/2001 |
| JP | 2001507997 | A | 6/2001 |
| JP | 2002028849 | A | 1/2002 |
| JP | 2002151447 | A | 5/2002 |
| JP | 3324643 | B2 | 9/2002 |
| JP | 2003303793 | A | 10/2003 |
| JP | 2004235446 | A | 8/2004 |
| JP | 3566430 | B2 | 9/2004 |
| JP | 2004243518 | A | 9/2004 |
| JP | 2004281685 | A | 10/2004 |
| JP | 2005074614 | A | 3/2005 |
| JP | 3641956 | B2 | 4/2005 |
| JP | 2005-294661 | A | 10/2005 |
| JP | 3801100 | B2 | 7/2006 |
| JP | 2006231464 | A | 9/2006 |
| JP | 2006305650 | A | 11/2006 |
| JP | 2007-005612 | A | 1/2007 |
| JP | 2007-235001 | A | 9/2007 |
| JP | 2007281435 | A | 10/2007 |
| JP | 4077192 | B2 | 4/2008 |
| JP | 2008207323 | A | 9/2008 |
| JP | 2009-101487 | A | 5/2009 |
| JP | 4512529 | B2 | 7/2010 |
| JP | 1693024 | B2 | 6/2011 |
| JP | 1798713 | B2 | 10/2011 |
| JP | 2013-018056 | A | 1/2013 |
| JP | 5143528 | B2 | 2/2013 |
| JP | 5226359 | B2 | 7/2013 |
| JP | 5248152 | B2 | 7/2013 |
| JP | 5697889 | B2 | 4/2015 |
| JP | 2016023209 | A | 2/2016 |
| JP | 5994183 | B2 | 9/2016 |
| JP | 6422325 | B2 | 11/2018 |
| JP | 6584895 | B2 | 10/2019 |
| KR | 10-2000-0075987 | A | 12/2000 |
| KR | 100303672 | B1 | 11/2001 |
| KR | 2003-0020658 | A | 3/2003 |
| KR | 2005-0052876 | A | 6/2005 |
| KR | 10-0606476 | B1 | 8/2006 |
| KR | 20070059846 | A | 6/2007 |
| KR | 20080038607 | A | 5/2008 |
| KR | 20100028294 | A | 3/2010 |
| KR | 1020130138841 | | 12/2013 |
| KR | 10-2015-0047628 | A | 5/2015 |
| KR | 20160083922 | A | 7/2016 |
| TW | I279287 | B | 4/2007 |
| TW | 201510203 | A | 3/2015 |
| WO | 9830356 | A1 | 7/1998 |
| WO | 0238688 | A3 | 10/2002 |
| WO | 33089702 | A1 | 10/2003 |
| WO | 33/103959 | A1 | 12/2003 |
| WO | 2006003697 | A1 | 1/2006 |
| WO | 2009158665 | A1 | 12/2009 |
| WO | 2011082155 | A2 | 7/2011 |
| WO | 2011088057 | A1 | 7/2011 |
| WO | 2012173885 | A3 | 5/2013 |
| WO | 2013128452 | | 9/2013 |
| WO | 2013162856 | A1 | 10/2013 |
| WO | 2014039378 | A1 | 3/2014 |
| WO | 2014/095200 | A1 | 6/2014 |
| WO | 2014141276 | A2 | 9/2014 |
| WO | 2015040433 | A2 | 3/2015 |
| WO | 2015055550 | A1 | 4/2015 |
| WO | 2015111366 | A1 | 7/2015 |
| WO | 2015118552 | A1 | 8/2015 |
| WO | 2015120430 | A1 | 8/2015 |

(56) References Cited

FOREIGN PATENT DOCUMENTS

| | | | |
|---|---|---|---|
| WO | 20150161210 | A1 | 10/2015 |
| WO | 2016140968 | A1 | 9/2016 |
| WO | 2017066077 | A1 | 4/2017 |
| WO | 2017078933 | A1 | 5/2017 |

OTHER PUBLICATIONS

PCT International Search Report and Written Opinion dated Nov. 13, 2018, for International Application No. PCT/US2018/043527.
EPOXY Technology Inc.—"Tech Tip 23: Tg—Glass Transition Temperature for Epoxies" brochure, date unknown, 2 pages.
Plastics in Action; 3-D Printing Speeds Prototype Development dated May/Jun. 1998; 2 total pages.
Wikipedia [online]; "3D Printing," as edited on Jul. 24, 2017 [retrieved on Nov. 9, 2018]; retrieved from the Internet: https://en.wikipedia.org/w/index.php?title=3D_printing&oldid=792037395, 17 pages.
3D Printing: The Next Industrial Revolution: Christopher Barnatt Publisher: CreateSpace Independent Publishing Platform (May 4, 2013) Language: English, ISBN-10:148418176X ISBN-13: 978-1484181768.
C. Wong. "Damping Associated with Incipient Melting in Aluminum-Indium Alloys", David Taylor Research Center—SME 89-99. Jan. 1990.
Tammy Hickey et al. "Internal Friction and Modules Studies on Austempered Ductile Iron", Technical Report ARCCB-TR-98001. Jan. 1996. 24 pages.
Rodel. Rodel IC1000 CMP Pad. 1999. 2 pages.
Byoung-Ho Kwon et al. "Dishing and Ersosion in STI CMP". System IC R&D Center, Hyundai Electronics Industries Co. Ltd. 1999 IEEE. 3 pages.
S. Raghavan et al. "Chemical Mechanical Planariarization in Integrated Circuit Device Manufacturing". vol. 98-7. 1998. 19 pages.
Rajeev Bajaj et al. "Effect of Polishing Pad Material Properties on Chemical Mechanical Polishing (CMP) Processes". 1994. 8 pages.
Rodel. Rodel IC1010. 1998. 2 pages.
Peter Freeman et al. "A Study of the Variation of Physical Properties in Random Lots of Urethane Polishing Pads for CMP". A Rodel Publication. vol. 2, Issue 6. Jun. 1996. 8 Pages.
John J. Aklonis et al. "Introduction to Polymer Viscoelasticity". Second Edition. 1983. 6 pages.
Weidan Li et al. "The Effect of the Polishing Pad Treatments on the Chemical-Mechanical Polishing of SiO2 Films", Thin Solid Films 270 (1995). 6 pages.
Peter Krober et al. "Reactive Inkjet Printing of Polyurethanes", www.rsc.org/materials. Journal of Materials Chemistry. Jan. 6, 2009.
Yu-Lim Jun et al. "Slicing Bitmap Generation and Patterning Technique a SFF System Using UV-Resin", International Conference on Control, Automation and Systems 2007. 5 Pages.
H. Yang. "High Viscosity Jetting System for 3D Reactive Inkjet Printing", Additive Manufacturing and 3D Printing Group, University of Nottingham. 9 pages.
I Hermant et al. "A Comparative Study of Polyurethane-Poly(Methyl Methacrylate) Interpenetrating and Semi-1 Interprenelrating Polymer Networks", vol. 20, No. 1. pp. 85-89, 1984.
Lee M. Cook. "CMP Consumables II: Pad" Chapter 6. Semiconductors and Semimetals, vol. 63. Published 1999. Chemical Mechanical Polishing in Silicon Processing. ISBN: 978-0-12-752172-5.
Antje M.J. Van Den Berg, "Inkjet Printing of Polyurethane Colloidal Suspensions", www.rsc.org/softmatter. Jul. 13, 2006.
The Dow Chemical Company—"Specialty Elastomers for Automotive TPO Compounds" brochure, Nov. 2006, 8 pages.
The Dow Chemical Company—"DOW VLDPE DFDB-1085 NT, Very Low Density Polyethylene Resin" Technical Data, UL Prospector, Oct. 2003, 2 pages.
Lubrizol Advanced Materials, Inc.—"Lubrizol Engineered Polymers, Estane 58144 TPU" Technical Data, Feb. 2014, 2 pages.
Sekisui Voltek, LLC—"Volara Type EO" Technical Data, Jan. 2010, 2 pages.
Rogers Corporation, High Performance Foams Division, PORON Microcellular Urethanes—Product Availability Booklet, May 1, 2015, 11 pages.
Wikipedia [online]; 3D Printing; 2013; 17 total pages.
Byoung-Ho Kwon et al. "Dishing and Erosion in STI CMP". System IC R&D Center, Hyundai Electronics Industries Co. Ltd. 1999 IEEE. 3 pages.
S. Raghavan et al. "Chemical Mechanical Planarization in Integrated Circuit Device Manufacturing". vol. 98-7. 1998. 19 pages.
Van Den Berg, Antje M.J. "Inkjet Printing of Polyurethane Colloidal Suspensions", www.rsc.org/softmatter. Jul. 13, 2006.
Andrews, Rodney J., et al.—"Glass Transition Temperatures of Polymers," Polymer Handbook, Fourth Edition, J. Brandrup et al., Editors, A Wiley Interscience Publication, John Wiley & Sons, Inc., 1999, VI / 193-198.
Crow—"Glass Transition Temperature," webpage, Polymer Properties Database, http://polymerdatabase.com/polymer%20physics/GlassTransition.html, 2015, printed Apr. 10, 2019, 2 pages.
Crow—"Glass Transition Temperatures," webpage, Polymer Properties Database, http://polymerdatabase.com/polymer%20physics/Polymer%20Tg%20C.html, 2015, printed Apr. 10, 2019, 6 pages.
HUPC—"Dipropylene Glycol Diacrylate (DPGDA)" webpage, CAS No. 57472-68-1_Radiation, http://www.union-pigment.com/china/radiation-curable-57472.html, printed Apr. 8, 2019, 2 pages.
Polysciences, Inc.—"Monomers Product Guide," 2012, 16 pages.
Whisnaut, David—"Polymer Chemistry: The Glass Transition" webpage, Engineering Libre Texts, https://eng.libretexts.org/Bookshelves/Materials_Schience?Supplemental_Modules_Materia . . . , printed Apr. 10, 2019, 2 pages.
Sigma-Aldrich—"Thermal Transitions of Homopolymers: Glass Transition & Melting Point" webpage, https://www.sigmaaldrich.com/technical-documents/articles/materials-science/polymer-scie . . . , printed Apr. 8, 2019, 3 pages.
Moylan, John—"Considerations for Measuring Glass Transition Temperature," webpage on Element Materials Technology's website, https://www.element.com/nucleus/2017/08/15/18/45/considerations-for-measuring-glass-transition-temperature, Feb. 19, 2019, 8 pages.
ASTM International—"Standard Test Method for Assignment of the Glass Transition Temperature by Dynamic Mechanical Analysis," standard issued under Designation E1640, current edition approved Aug. 1, 2013, 6 pages.
Wikipedia—"Contact angle" webpage, https://en.wikipedia.org/wiki/Contact_angle, last edited Dec. 14, 2019, 9 pages.
ASTM International—"Standard Terminology for Additive Manufacturing Technologies," ASTM Designation F2792-12a, copyright dated Sep. 9, 2013, pp. 1-3.
Merriam-Webster Dictionary—"Droplet," https://www.merriam-webster.com/dictionary/droplet, accessed Feb. 24, 2020, 8 pages.
Shahrubudin, N., et al.—"An Overview on 3D Printing Technology: Technological, Materials, and Applications," 2nd International Conference on Sustainable Materials Processing and Manufacturing (SMPM 2019), Procedia Manufacturing, 35 (2019), published by Elsevier B.V., pp. 1286-1296.
Wikipedia—"Drop (liquid)," https://en.wikipedia.org/wiki/Drop_(liquid), last edited Feb. 12, 2020, accessed Feb. 24, 2020, 5 pages.
Wikipedia—"Cross-link" webpage at <https://en.wikipedia.org/wiki/Cross-link>, printed Mar. 8, 2019, 8 pages.
J.-G. Park, et al., Post-CMP Cleaning: Interaction between Particles and Surfaces, International Conference on Planarization/CMP Technology, Oct. 25-27, 2007, VDE Verlag CMBH, Berlin-Offenbach, 6 pp.
Rao, Sunil M., The Effectiveness of Silane and Siloxane Treatments on the Superhydrophobicity and Icephobicity of Concrete Surfaces, RAO, PhD Thesis, 1-118.
A Breakthrough Method for the Effective Conditioning of PVA Brush Used for Post-CMP Process, Lee et al., ECS Journal of Solid State Science and Technology 8, P307-P312 (2019), Published Jun. 5, 2019, 6 pages.
Influence of post-CMP cleaning on Cu interconnects and TDDB reliability, Noguchi et al., IEEE Transactions on Electron Devices 52, 934-941 (2005), Published Apr. 25, 2005, 8 pages.

(56) References Cited

OTHER PUBLICATIONS

Arkema, "Liquid Resins for UV Curling", N3XTDIMENSION. Sartomer's Custom Liquid Resin Systems. 3D-arkema.com.
GPS Safety Summary, "Tripropyleneglycol diacrylate", (TPGDA—SR 306)—Mar. 11, 2013.
Shyam Dev Maurya et al. "A Review on Aery late-Terminated Urethane Oligomers and Polymers: Synthesis and Applications", Polymer-Plastics Technology and Engineering. ISSN:0360-2559 (Print) 1525-6111 (Online) Journal homepage: https://www.tandfonline.com/loi/lpte20.
UV/EB Curable Resins. Product Guide—Americas. www.allnex.com.
"Poly(Vinyl Acetate)" https://www.chemicalbook.com/ChemicalProductProperty_EN_GB3700594.htm, ChemicalBook, 2017, 4 pp.
"Polyvinyl acetate solubility," https://chempedia.info/info/polyvinyl_acetate_solubility/, Big Chemical Encyclopedia, 2019, 4 pp.
American Polymer Standards Corporation Safety Data Sheet, Polyvinyl Acetate, Date of Issue: Mar. 24, 2014, Last Revision Date: Mar. 25, 2019, 5 pp.

* cited by examiner

ABRASIVE DELIVERY POLISHING PADS AND MANUFACTURING METHODS THEREOF

CROSS-REFERENCE TO RELATED APPLICATIONS

This application claims benefit of U.S. Provisional Application Ser. No. 62/542,136, filed on Aug. 7, 2017, which is herein incorporated by reference in its entirety.

BACKGROUND

Field

Embodiments of the present disclosure generally relate to a polishing pad, and methods of forming a polishing pad, and more particularly, to a polishing pad used for polishing a substrate in an electronic device fabrication process.

Description of the Related Art

Chemical mechanical polishing (CMP) is commonly used in the manufacture of high-density integrated circuits to planarize or polish a layer of material deposited on a substrate, by contacting the material layer to be planarized with a polishing pad and moving the polishing pad and/or the substrate (and thus the material layer surface) in the presence of a polishing fluid and abrasive particles. Two common applications of CMP are planarization of a bulk film, for example pre-metal dielectric (PMD) or interlayer dielectric (ILD) polishing, where underlying features create recesses and protrusions in the layer surface, and shallow trench isolation (STI) and interlayer metal interconnect polishing, where polishing is used to remove a via, contact or trench fill material from the exposed surface (field) of the layer having the feature extending thereinto.

In a typical CMP process, the substrate is retained in a carrier head that presses the backside of the substrate toward the polishing pad. Material is removed across the material layer surface in contact with the polishing pad through a combination of chemical and mechanical activity that is provided, in part, by the polishing fluid and the abrasive particles. Typically, the abrasive particles are either suspended in the polishing fluid to provide a slurry, or are embedded in the polishing pad, known as a fixed abrasive polishing pad.

When abrasive particles are provided in the polishing fluid (slurry) a non-abrasive polishing pad (i.e. a polishing pad that does not provide the abrasive particles) is typically used to transport the abrasive particles to the material layer of the substrate (herein a conventional CMP process) where the abrasive particles cause mechanical abrasion, and in some embodiments, a chemical reaction, with the substrate surface. In general, slurry is continuously flowed during the polishing portion of the CMP process so that fresh abrasive particles (abrasive particles that have not interacted with the material surface of the substrate) are continuously transported to the material layer of the substrate. The motion of the abrasive particles in a conventional CMP process provides a substantially three dimensional interaction between the polishing pad, the substrate, and the abrasive particles as the abrasive particles are in continuous motion with respect to both the polishing pad and the material surface of the substrate.

In contrast, with a fixed abrasive polishing pad (herein a fixed abrasive CMP process), the abrasive particles are typically integrated into the polishing pad by embedding them in a supporting material, which is often referred to as a binder material, such as an epoxy resin. Generally, during a CMP process, the binder material fixedly holds the abrasive particles in place at the polishing pad surface where they provide mechanical polishing action to, and sometimes chemical reaction with, the material layer of the substrate during the CMP process. The motion of the abrasive particles in a fixed abrasive CMP process provides a substantially two dimensional interaction between the polishing pad (and the abrasive particles embedded therein) and the substrate.

Generally, fixed abrasive polishing pads are superior to standard (non-fixed abrasive polishing pads) in some aspects of polishing performance. For example, using a fixed abrasive pad, there is less undesirable erosion of planar surfaces in areas with high feature density and less undesirable dishing of the upper surface of the film material in recessed features such as trenches, contacts, and lines. However, fixed abrasive polishing pads tend to have lower lifetimes (minutes of polishing per pad), inferior substrate to substrate stability for film removal rate from the substrate surface, and inferior substrate to substrate stability for uniformity of film removal across the substrate from substrate to substrate. Further, methods of forming fixed abrasive polishing pads often involve coating the abrasive particles, at least in part, with a polymer composition which reduces the abrasiveness and/or the chemical potential of the abrasive particles, which undesirably impacts CMP polishing performance. In contrast, slurries used in conventional CMP processes are costly and require specialized distribution systems.

Accordingly, what is needed in the art are polishing pads capable of providing and delivering abrasive particles into the polishing fluid (abrasive delivery polishing pads) during CMP, methods of forming abrasive delivery polishing pads, and methods of polishing a substrate using the formed abrasive delivery polishing pads.

SUMMARY

Embodiments herein generally relate to an abrasive delivery (AD) polishing pad comprising water soluble abrasive delivery features disposed in the polishing material of portions of the polishing pad, and methods of forming thereof.

In one embodiment, a method of forming a polishing article includes forming a sub-polishing element from a first curable resin precursor composition and forming a plurality of polishing elements extending from the sub-polishing element. Forming the plurality of polishing elements includes forming a continuous polymer phase from a second curable resin precursor composition and forming a plurality of discontinuous abrasive delivery features disposed within the continuous polymer phase. The sub-polishing element is formed by dispensing a first plurality of droplets of the first curable resin precursor composition. The plurality polishing elements are formed by dispensing a second plurality of droplets of the second curable resin precursor composition. In some embodiments, the discontinuous abrasive delivery features comprise a water soluble material having abrasive particles interspersed therein.

In another embodiment, a polishing article comprises a sub-polishing element comprising a first continuous polymer phase and a plurality of polishing elements extending from the sub-polishing element. The plurality of polishing elements comprises a second continuous polymer phase and a plurality of abrasive particle delivery features disposed in the second continuous polymer phase, the abrasive particle delivery features comprising a support material having abrasive particles interspersed therein.

In another embodiment, a polishing article comprises a sub-polishing element comprising a first reaction product of a plurality of first droplets of a first precursor composition and a plurality of polishing elements extending from the sub-polishing element comprising a second reaction product of a plurality of droplets of a second precursor composition. In some embodiments, the polishing article further comprises a plurality of discontinuous abrasive delivery features disposed in one or more of the plurality of polishing elements comprising a water soluble support material having abrasive particles interspersed therein. In some embodiments, the polishing article further comprises a plurality of interfaces coupling the sub-polishing element to the plurality of polishing elements, wherein one or more of the plurality of interfaces comprises a third reaction product of the first precursor composition and the second precursor composition.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments described herein generally relate to polishing articles and methods for manufacturing polishing articles used in a polishing process. More specifically, embodiments herein relate to abrasive delivery (AD) polishing pads, and methods of manufacturing AD polishing pads, which provide abrasive particles to the interface between the polishing pad surface and a material surface of a substrate. The AD polishing pads facilitate three dimensional interactions between the polishing pad, the abrasive particles, and the substrate during the polishing process. The ability to deliver abrasive particles to the polishing interface enables a polishing process without the use of expensive slurries and slurry distribution systems. However, in some embodiments, a polishing slurry is used to supplement the abrasive particles provided by the AD polishing pad.

Herein the polishing articles described as polishing pads, and methods of forming thereof, are applicable to other polishing applications including, for example, buffing. Further, although the discussion is generally in relation to chemical mechanical polishing (CMP) processes, the articles and methods are also applicable to other polishing processes using both chemically active and chemically inactive polishing fluids. In addition, embodiments described herein may be used in at least the following industries: aerospace, ceramics, hard disk drive (HDD), MEMS and Nano-Tech, metalworking, optics and electro-optics, and semiconductor, among others.

Embodiments of the present disclosure provide for abrasive delivery (AD) polishing pads that include discontinuous abrasive delivery features disposed within a polishing pad material. The AD polishing pads are formed using an additive manufacturing process, such as a two-dimensional 2D or three-dimensional 3D inkjet printing process. Additive manufacturing processes, such as the three-dimensional printing ("3D printing") process described herein, enable the formation of AD polishing pads with discrete polishing regions, polishing elements, and/or polishing features having unique properties and attributes. Generally, the polymers of the polishing elements form chemical bonds, for example covalent bonds or ionic bonds, with the polymers of adjacent polishing elements at the interfaces thereof. The chemical bonds typically comprise the reaction product of one or more curable resin precursors used to form adjacent polishing elements. Because the polishing elements are linked with adjacent polishing elements by chemical bonding, the interfaces are stronger and more robust than polishing pads having discrete elements attached using other methods, such as with adhesive layers or by thermal bonding. Stronger interfaces allow for the use of a more aggressive polishing or conditioning process therewith when desired.

Figure 1:
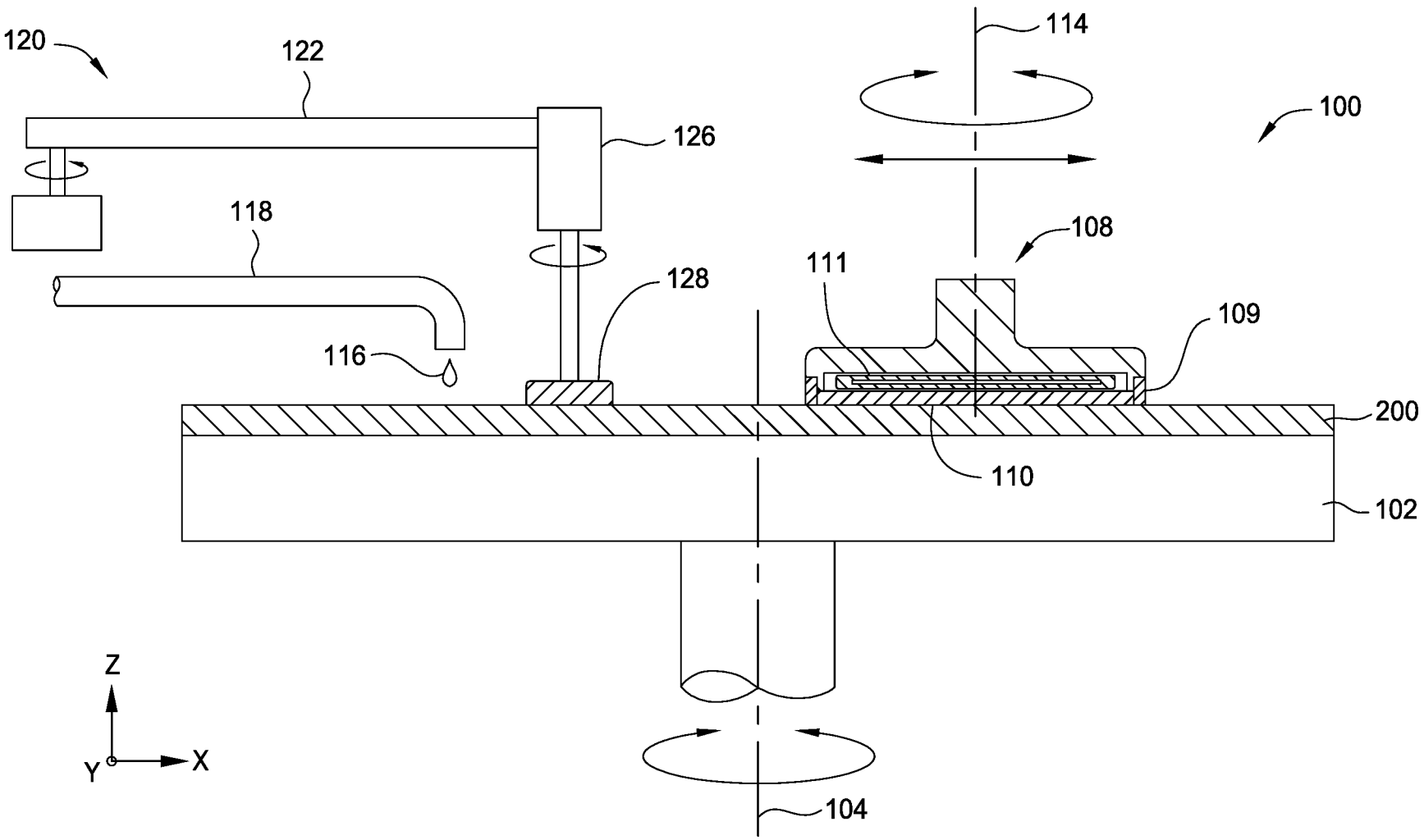
FIG. 1 is a schematic sectional view of a polishing system using an abrasive delivery (AD) polishing pad formed according to embodiments described herein.

FIG. 1 is a schematic sectional view of an example polishing system 100 using an AD polishing pad 200 formed according to the embodiments described herein. Typically, the AD polishing pad 200 is secured to a platen 102 of the polishing system 100 using an adhesive, such as a pressure sensitive adhesive, disposed between the AD polishing pad 200 and the platen 102. A substrate carrier 108, facing the platen 102 and the AD polishing pad 200 mounted thereon, has a flexible diaphragm 111 configured to impose different pressures against different regions of a substrate 110 while urging the material surface of the substrate 110 against the polishing surface of the AD polishing pad 200. The substrate carrier 108 includes a carrier ring 109 surrounding the substrate 110. During polishing, a downforce on the carrier ring 109 urges the carrier ring 109 against the AD polishing pad 200 to prevent the substrate 110 from slipping from the substrate carrier 108. The substrate carrier 108 rotates about a carrier axis 114 while the flexible diaphragm 111 urges the substrate 110 against the polishing surface of the AD polishing pad 200. The platen 102 rotates about a platen axis 104 in an opposite direction from the rotation of the substrate carrier 108 while the substrate carrier 108 sweeps back and forth from an inner diameter of the platen 102 to an outer diameter of the platen 102 to, in part, reduce uneven wear of the AD polishing pad 200. Herein, the platen 102 and the AD polishing pad 200 have a surface area that is greater than a surface area of the substrate 110, however, in some polishing systems, the AD polishing pad 200 has a surface area that is less than the surface area of the substrate 110.

During polishing, a fluid 116 is introduced to the AD polishing pad 200 through a fluid dispenser 118 positioned over the platen 102. Typically, the fluid 116 is a polishing fluid (including water), a polishing slurry, a cleaning fluid, or a combination thereof. In some embodiments, the fluid 116 us a polishing fluid comprising a pH adjuster and/or chemically active components, such as an oxidizing agent, to enable chemical mechanical polishing of the material surface of the substrate 110 in conjunction with the abrasives of the AD polishing pad 200.

Typically, the polishing system 100 includes a pad conditioning assembly 120 that comprises a conditioner 128, such as a fixed abrasive conditioner, for example a diamond conditioner. The conditioner 128 is coupled to a conditioning arm 122 having an actuator 126 that rotates the conditioner 128 about its center axis. while a downforce is applied to the conditioner 128 as it sweeps across the AD polishing pad 200 before, during, and/or after polishing the substrate 110. The conditioner 128 abrades and rejuvenates the AD polishing pad 200 and/or cleans the AD polishing pad 200 by removing polish byproducts or other debris from the polishing surface thereof.

Figure 2A:
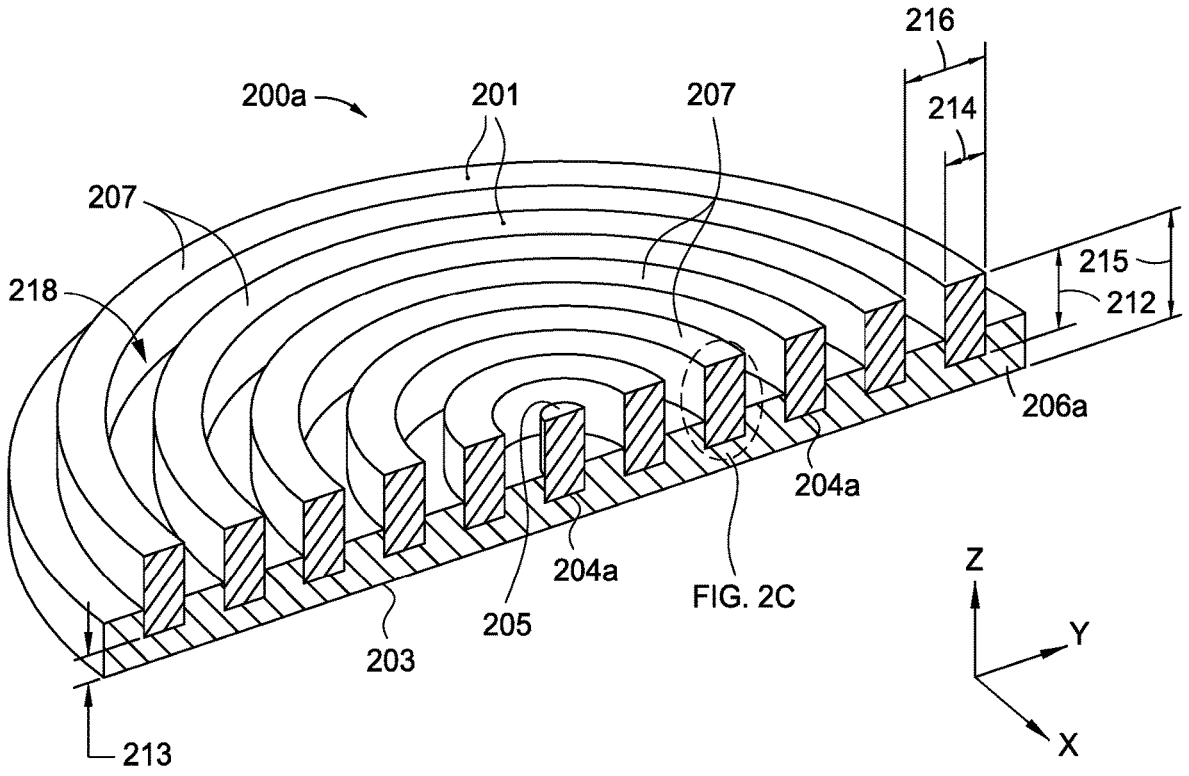
FIGS. 2A-2B are schematic perspective sectional views of abrasive delivery (AD) polishing pads formed according to embodiments described herein.
Figure 2B:
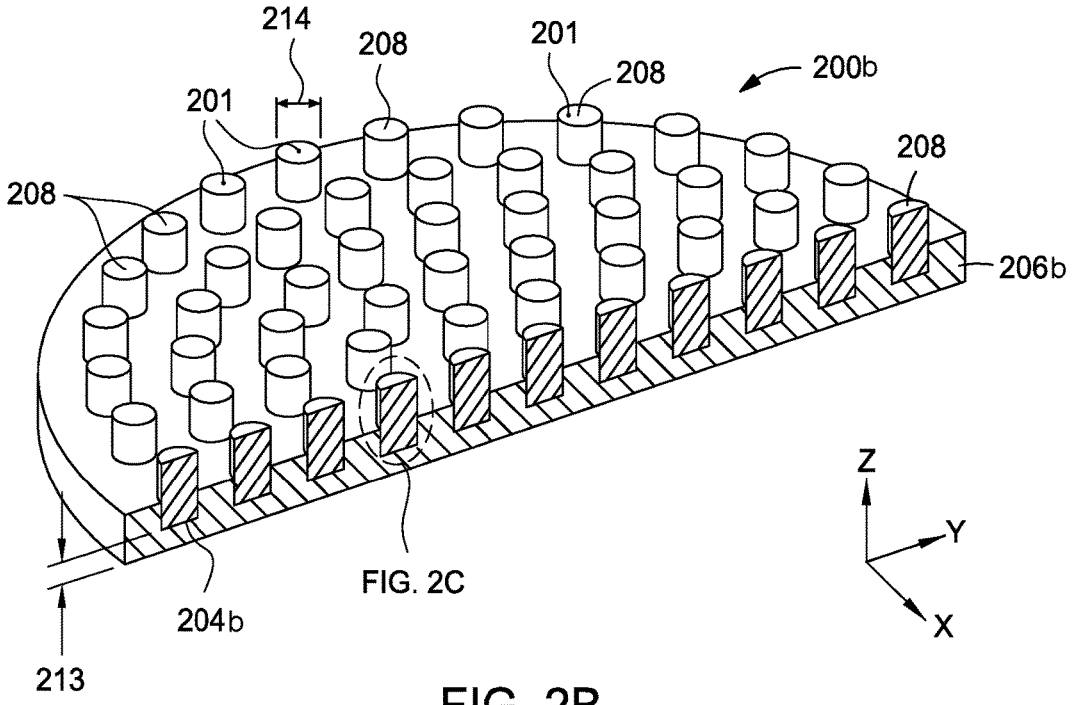

FIGS. 2A and 2B are schematic perspective sectional views of AD polishing pads 200*a*, 200*b* formed according to embodiments described herein. The AD polishing pads 200*a*, 200*b* can be used as the AD polishing pad 200 in the polishing system 100 of FIG. 1. In FIG. 2A, the AD polishing pad 200*a* comprises a plurality of polishing elements 204*a* that are disposed within a sub-polishing element 206*a*, and extend from a surface of the sub-polishing element 206*a*. One or more of the plurality of polishing elements 204*a* have a first thickness 212, the sub-polishing element 206*a* extends beneath the polishing element 204*a* at a second thickness 213, and the polishing pad 200*a* has an overall third thickness 215. As illustrated in FIGS. 2A and 2B, the polishing elements 204*a*, 204*b* are supported by a portion of the sub-polishing element 206*a*, 206*b* (e.g., portion within the first thickness 212). Therefore, when a load is applied to the polishing surface 201 of the AD polishing pads 200*a*, 200*b* (e.g., top surface) by a substrate during processing, the load will be transmitted through the polishing elements 204*a*, 204*b* and a portion of the sub-polishing element 206*a*, 206*b* located therebeneath.

As shown in FIG. 2A, the plurality of polishing elements 204*a* include a post 205 disposed in the center of the AD polishing pad 200*a* and a plurality of concentric rings 207 disposed about the post 205 and spaced radially outwardly therefrom. The plurality of polishing elements 204*a* and the sub-polishing element 206*a* define a plurality of circumferential channels 218 disposed in the AD polishing pad 200*a* between each of the polishing elements 204*a* and between a plane of the polishing surface 201 of the AD polishing pad 200*a* and a surface of the sub-polishing element 206*a*. The plurality of channels 218 enable the distribution of polishing fluid 116 across the AD polishing pad 200*a* and to the interface region between the AD polishing pad 200*a* and the material surface of a substrate 110. In other embodiments, the patterns of the polishing elements 204*a* are rectangular, spiral, fractal, random, another pattern, or combinations thereof. Herein, a width 214 of the polishing element(s) 204*a*, 204*b* is between about 250 microns and about 5 millimeters, such as between about 250 microns and about 2 millimeters. A pitch 216 between the polishing element(s) 204*a* is between about 0.5 millimeters and about 5 millimeters. In some embodiments, the width 214 and/or the pitch 216 varies across the radius of the AD polishing pad 200*a*, 200*b* to define zones of pad material properties and/or abrasive particle concentration. Additionally, the center of the series of polishing elements 204*a, b* may be offset from the center of the sub-polishing element 206*a, b*.

In FIG. 2B, the polishing elements 204*b* are shown as circular cylindrical columns extending from the sub-polishing element 206*b*. In other embodiments, the polishing elements 204*b* are of any suitable cross-sectional shape, for example columns with toroidal, partial toroidal (e.g., arc), oval, square, rectangular, triangular, polygonal, irregular shapes, or combinations thereof. In some embodiments, the shapes and widths 214 of the polishing elements 204*b*, and the distances therebetween, are varied across the AD polishing pad 200*b* to tune the hardness, mechanical strength, fluid transport characteristics, or other desirable properties of the complete AD polishing pad 200*b*.

Herein, the polishing elements 204*a*, 204*b* and the sub-polishing elements 206*a*, 206*b* each comprise a continuous polymer phase formed from of at least one of oligomeric and/or polymeric segments, compounds, or materials selected from the group consisting of: polyamides, polycarbonates, polyesters, polyether ketones, polyethers, polyoxymethylenes, polyether sulfone, polyetherimides, polyimides, polyolefins, polysiloxanes, polysulfones, polyphenylenes, polyphenylene sulfides, polyurethanes, polystyrene, polyacrylonitriles, polyacrylates, polymethylmethacrylates, polyurethane acrylates, polyester acrylates, polyether acrylates, epoxy acrylates, polycarbonates, polyesters, melamines, polysulfones, polyvinyl materials, acrylonitrile butadiene styrene (ABS), halogenated polymers, block copolymers and random copolymers thereof, and combinations thereof.

In some embodiments, the materials used to form portions of the AD polishing pads 200*a*, 200*b*, such as the first polishing elements 204*a*, 204*b* and the sub-polishing elements 206*a*, 206*b* will include the reaction product of at least one ink jettable pre-polymer composition that is a mixture of functional polymers, functional oligomers, reactive diluents, and/or curing agents to achieve the desired properties of an AD polishing pad 200*a*, 200*b*. In some embodiments, interfaces between, and coupling between, the first polishing elements 204*a*, 204*b* and the sub-polishing element 206*a*, 206*b* include the reaction product of a first pre-polymer composition, such as a first curable resin precursor composition, used to form the first polishing elements 204*a*, 204*b* and a second pre-polymer composition, such as a second curable resin precursor composition, used to form the second polishing elements 206*a*, 206*b*. In general, the pre-polymer compositions are exposed to electromagnetic radiation, which may include ultraviolet radiation (UV), gamma radiation, X-ray radiation, visible radiation, IR radiation, and microwave radiation and also accelerated electrons and ion beams to initiate polymerization reactions, to form the continuous polymer phases of the polishing elements 204*a*, 204*b* and the sub-polishing elements 206*a*, 206*b*. For the purposes hereof, we do not restrict the method of polymerization (cure), or the use of additives to aid the polymerization, such as sensitizers, initiators, and/or curing agents, such as through cure agents or oxygen inhibitors.

Figure 2C:
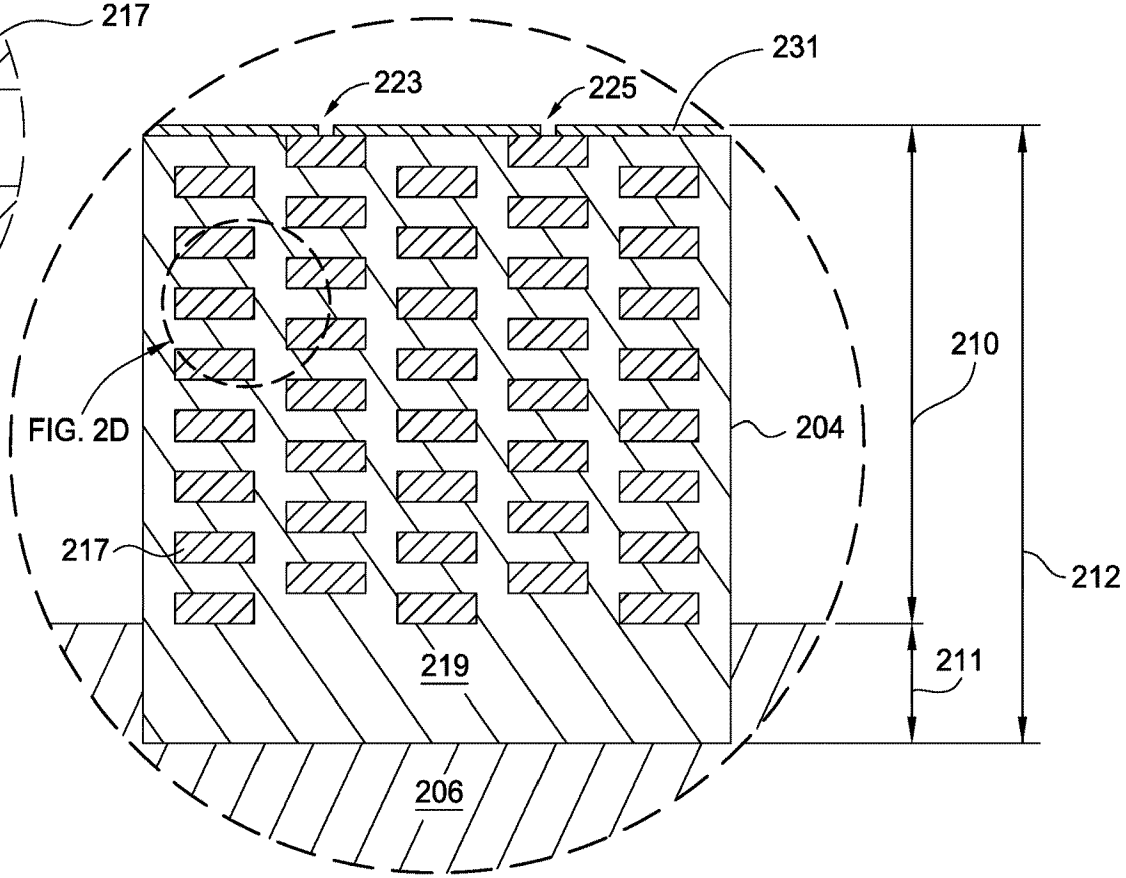
FIGS. 2C and 2D are close up sectional views of a portion of either of the abrasive delivery (AD) polishing pads shown in FIGS. 2A and 2B.
Figure 2D:
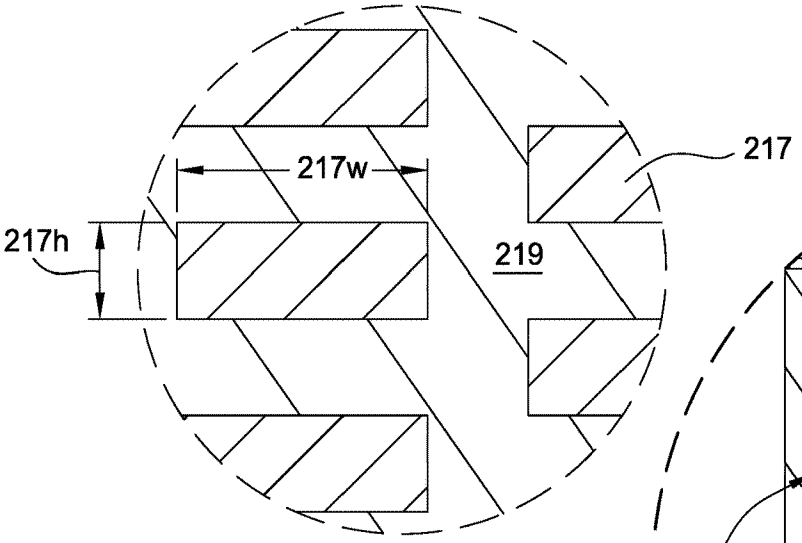

FIGS. 2C and 2D are close up sectional views of a portion of the polishing pads 200*a*, 200*b* shown in FIGS. 2A and 2B. In FIG. 2B one of the plurality of polishing elements 204*a*, 204*b* is shown extending inwardly of the sub-polishing element 206*a*, 206*b* by sub-height 211 and extending beyond the surface of the sub-polishing element 206*a*, 206*b* by a protrusion height 210. Herein, at least a portion of the one of the plurality of polishing elements 204*a*, 204*b* includes a plurality of discontinuous abrasive delivery features 217 disposed in a continuous polymer phase of a polishing material 219, where the abrasive delivery features 217 are between about 2 wt % and about 60 wt % of the polishing element 204*a*, 204*b*. The abrasive delivery features 217 are formed from a support material, such as a water soluble support material, having abrasive particles interspersed therein. Typically, the support material of the abrasive delivery features 217 is selected from the group consisting of water soluble polymers, water soluble inert materials, water-containing hydrophilic polymers, hydrophilic polymerizable monomers in water, and combinations thereof. Herein, the water soluble support material may be uncured, partially cured, or cured. Abrasive particles interspersed in the support material include silica, aluminum oxide, aluminum silicate ceramic, cerium oxide, silicon carbide, titanium dioxide, alumina-zirconia, and combinations thereof. Typically, the abrasive delivery features 217, formed according to embodiments described herein, have an average feature width 217*w* of between about 1 μm and about 500 μm and a feature height 217*h* of between about 1 μm and about 500 μm. Abrasive particles, and/or agglomerations thereof, interspersed in the support material have a mean diameter of between about 10 nm and about 5 μm, such as between about 30 nm and about 500 nm, such as between about 30 nm and 300 nm, for example between about 100 nm and about 150 nm. Typically, the concentration of the abrasive particles in the support material of the abrasive delivery feature 217 is between about 0.1% and about 90 wt. %, such as less than about 50 wt. %, such as between about 1 wt. % and about 50 wt. %, between about 1 wt. % and about 40 wt. %, between about 1 wt. % and about 30 wt. %, between about 1 wt. % and about 20 wt. %, between about 1 wt. % and about 10 wt. %, for example between about 1 wt. % and about 5 wt. %. In some embodiments, the concentration of abrasive particles in the support material of the abrasive delivery feature 217 is more than about 50%, such as more than about 60% such as more than about 70%, for example more than about 80%. In some embodiments, the vertical locations of abrasive delivery features 217 are staggered, such as shown such as shown in FIG. 2C, so that as the AD polishing pad 200*a*, 200*b* wears through polishing use, and/or conditioning with a fixed abrasive conditioning disk, new abrasive delivery features 217 are opened at the polishing surface 201 of the polishing elements 204*a*, 204*b* at different times, to provide a fresh source of abrasive particles with each successive substrate polished.

In some embodiments, the polishing elements 204*a*, 200*b* further include an impermeable material layer 231 disposed over the polishing material 219 and the abrasive delivery features 217. Openings 233 and 235 in the impermeable material layer 231 allow polishing fluids 116 to reach the abrasive delivery features 217 at selected locations. Herein, the polishing material 219 and the material of the impermeable material layer 231 are the same material, however, in other embodiments they are different materials. In operation, the polishing pad 200*a*, 200*b* is mounted on the platen 102 and exposed to polishing fluids 116. The water soluble material of the abrasive delivery features 217 initially swells as it absorbs the (aqueous) polishing fluid 116 to push the abrasive particles out of the openings 233 and 235 onto the surface of the polishing element 204*a*, 204*b*. The impermeable material layer 231 prevents polishing fluids 116 from reaching the abrasive delivery features 217 except in desired locations. Desired locations are controlled by selectively removing portions of the impermeable material layer 231 to expose the abrasive delivery features 217 underneath. This removal can be done using a laser, mechanical means, or any other method suitable for forming openings 233 through the impermeable material layer 231. Typically, the impermeable material layer 231 is formed of the same material that forms the continuous polymer phase of the polishing elements 204*a*, 204*b*.

In one embodiment, two or more of the polishing elements, such as two or more of the polishing elements 204*a* or two or more of the polishing elements 204*b* and the sub-polishing elements 206*a*, 206*b* within a unitary pad body, are formed from the sequential deposition and post deposition processing and comprise the reaction product of at least one radiation curable resin precursor composition, wherein the radiation curable precursor compositions contain functional polymers, functional oligomers, monomers, and/or reactive diluents that have unsaturated chemical moieties or groups, including but not restricted to: vinyl groups, acrylic groups, methacrylic groups, allyl groups, and acetylene groups. The hardness and/or storage modulus E' of the materials found within the polishing elements 204*a*, 204*b* and the sub-polishing elements 206*a*, 206*b* are different, such that the values of the hardness and/or storage modulus E' for the polishing elements 204*a*, 204*b* are greater than those of the sub-polishing elements 206*a*, 206*b*. In some embodiments, the material composition and/or material properties of the polishing elements 204*a*, 204*b* vary from polishing element to polishing element. Individualized material composition and/or material properties allow for the tailoring of the polishing pad material composition properties for specific polishing needs.

Benefits of abrasive delivery (AD) polishing pads 200*a*, 200*b* as described above include the ability to provide abrasive particles to the CMP process through the pad, as opposed to through a slurry delivery system, while maintaining polishing properties of the abrasive particles and the polishing pad that are similar to a conventional (non-fixed abrasive polishing pad) polishing process. Typical AD polishing pad material composition properties that may be selected using the methods and material compositions described herein include storage modulus E', loss modulus E", hardness, tan δ, yield strength, ultimate tensile strength, elongation, thermal conductivity, zeta potential, mass density, surface tension, Poison's ratio, fracture toughness, surface roughness ($R_a$), glass transition temperature (Tg) and other related properties. For example, storage modulus E' influences polishing results such as the removal rate from, and the resulting-planarity of, the material layer surface of a substrate. Typically, polishing pad material compositions having a medium or high storage modulus E' provide a higher removal rate for dielectric films used for PMD, ILD, and STI, and cause less undesirable dishing of the upper surface of the film material in recessed features such as trenches, contacts, and lines. Polishing pad material compositions having a low storage modulus E' generally provide more stable removal rates over the lifetime of the polishing pad, cause less undesirable erosion of a planer surface in areas with high feature density, and cause reduced micro scratching of the material surface. Characterizations as a low, medium, or high storage modulus E' pad material composition at temperatures of 30° C. (E'30) and 90° C. (E'90) are summarized in Table 1:

TABLE 1

| | Low Storage Modulus Compositions | Medium Modulus Compositions | High Modulus Compositions |
|---|---|---|---|
| E'30 | 5 MPa-100 MPa | 100 MPa-500 MPa | 500 MPa-3000 MPa |
| E'90 | <17 MPa | <83 MPa | <500 MPa |

In embodiments herein, the sub-polishing elements 206*a*, 206*b* are formed from materials different from the materials forming the polishing elements 204*a*, 204*b*, such as materials having a low (soft) or moderate storage modulus E'. The polishing elements 204*a*, 204*b* are typically formed from materials having a medium or high (hard) storage modulus E'. It has been found that CMP processes that use soft or low storage modulus E' polishing pads tend to have non-uniform planarization results due to the relative ease with which a soft or low storage modulus E' polishing pad deforms under the applied force generated by the carrier ring 109 (FIG. 1) and the applied force generated by the flexible diaphragm 111 during a CMP process. In other words, the soft, flexible and low storage modulus E' nature of the material used to form the soft or low storage modulus E' polishing pad allows the effect of the force, supplied by the carrier ring 109, to be minimized, which improves the ability of the pad to compensate for carrier ring downforce. In contrast, fixed abrasive polishing pads typically utilize a support material that has a high hardness value to physically hold the abrasive particles in place. However, it has been found that CMP processes that use "hard" polishing pad materials, such as a support material comprising an epoxy resin, tend to have non-uniform planarization results at the edges of the substrate 110 being polished (FIG. 1) due to the epoxy resins' low ability to compensate for carrier ring downforce. One of the benefits of the AD polishing pads disclosed herein, in contrast with conventional polishing pads, is the ability to provide abrasive particles at a controlled local (high and/or low) density to the interface of the polishing pad and the material surface of a substrate without the use of a slurry, or slurry distribution system, while maintaining the flexibility to tune material properties of the polishing pad to suit specific process needs.

Figure 3A:
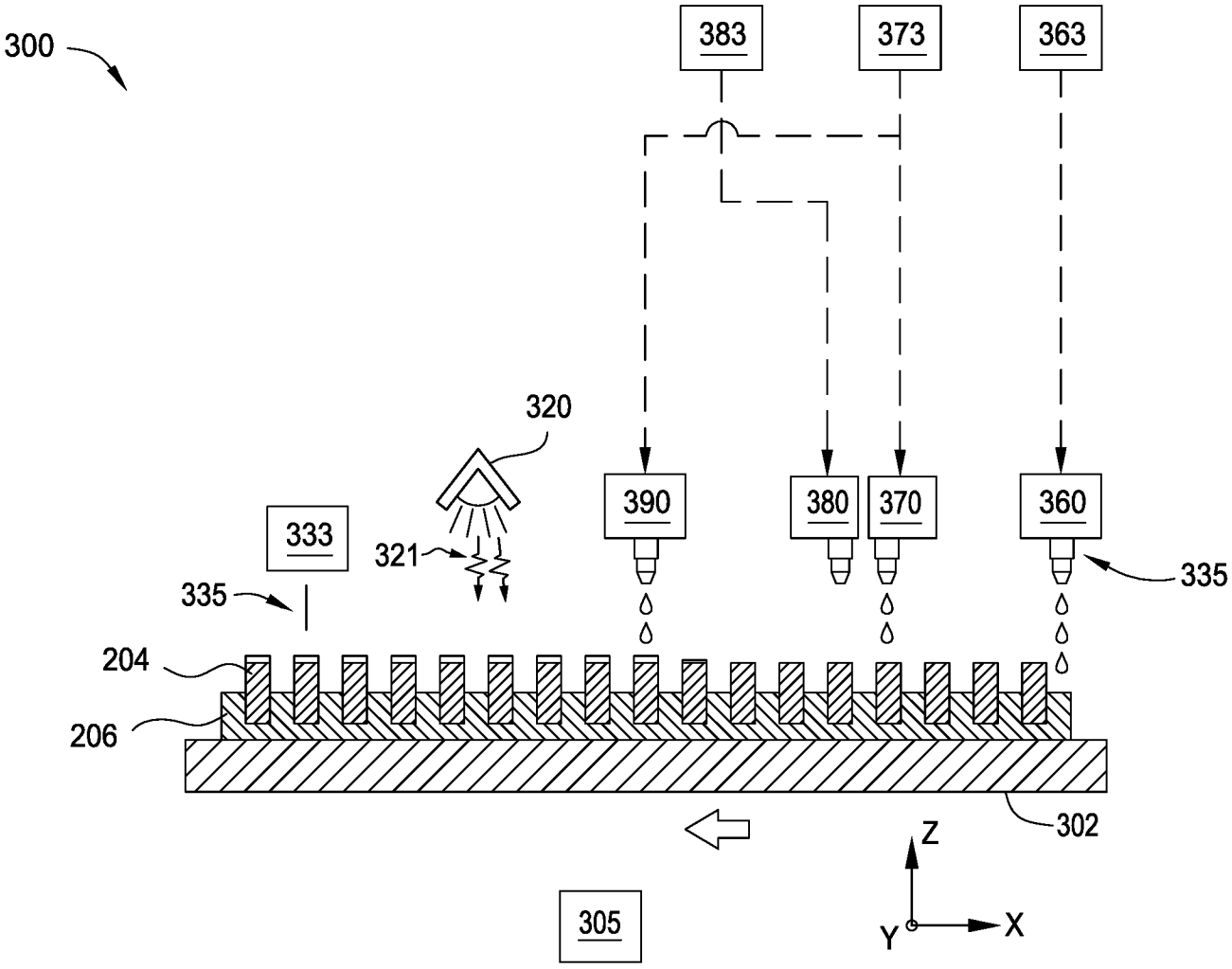
FIG. 3A is a schematic sectional view of an additive manufacturing system used to form abrasive delivery (AD) polishing pads, according to embodiments described herein.

FIG. 3A is a schematic sectional view of an additive manufacturing system 300 used to form an AD polishing pad, such as polishing pads 200*a*, 200*b*, according to embodiments disclosed herein. Herein, the additive manufacturing system 300 includes a first dispensing head 360 for dispensing droplets of a first precursor composition 363, a second dispensing head 370 for dispensing droplets of a second precursor composition 373, and a third dispensing head 380 for dispensing droplets of a third precursor composition. In some embodiments, a forth dispensing head 390 is used to dispense droplets of the second precursor composition 373 to form the impermeable material layer 231. In other embodiments, the impermeable material layer 231 is formed using the second dispensing head. Typically, the dispensing heads 360, 370, 380, 390 move independently of each other and independently of a manufacturing support 302 during the printing process which enables the placement of droplets of the precursor compositions 363, 373, an 383 at selected locations on the manufacturing support 302 to form a polishing pad, such as the polishing pads 200*a*, 200*b*. The selected locations are collectively stored as a CAD-compatible printing pattern which is readable by an electronic controller 305 that directs the motion of the manufacturing support 302, the motion of the dispensing head 360, 370, 380 and the delivery of the droplets from one or more nozzles 335.

Herein, the first precursor composition 363 is used to form the sub-polishing elements 206*a*, 206*b*, and the second and third precursor compositions 373 and 383 are used to form the polishing elements 204*a*, 204*b* of the AD polishing pads 200*a*, 200*b* shown in FIGS. 2B-2C. The first and second precursor compositions 363 and 373 each comprise a mixture of one or more of functional polymers, functional oligomers, monomers, and/or reactive diluents that are at least monofunctional, and undergo polymerization when exposed to free radicals, Lewis acids, and/or electromagnetic radiation.

Examples of functional polymers include multifunctional acrylates including di, tri, tetra, and higher functionality acrylates, such as 1,3,5-triacryloylhexahydro-1,3,5-triazine or trimethylolpropane triacrylate.

Examples of functional oligomers include monofunctional and multifunctional oligomers, acrylate oligomers, such as aliphatic urethane acrylate oligomers, aliphatic hexafunctional urethane acrylate oligomers, diacrylate, aliphatic hexafunctional acrylate oligomers, multifunctional urethane acrylate oligomers, aliphatic urethane diacrylate oligomers, aliphatic urethane acrylate oligomers, aliphatic polyester urethane diacrylate blends with aliphatic diacrylate oligomers, or combinations thereof, for example bisphenol-A ethoxylate diacrylate or polybutadiene diacrylate. In one embodiment, the functional oligomer comprises tetrafunctional acrylated polyester oligomer available from Allnex Corp. of Alpharetta, Ga. as EB40® and the functional oligomer comprises an aliphatic polyester based urethane diacrylate oligomer available from Sartomer USA of Exton, Pa. as CN991.

Examples of monomers include both mono-functional monomers and multifunctional monomers. Mono-functional monomers include tetrahydrofurfuryl acrylate (e.g. SR285 from Sartomer®), tetrahydrofurfuryl methacrylate, vinyl caprolactam, isobornyl acrylate, isobornyl methacrylate, 2-phenoxyethyl acrylate, 2-phenoxyethyl methacrylate, 2-(2-ethoxyethoxy)ethyl acrylate, isooctyl acrylate, isodecyl acrylate, isodecyl methacrylate, lauryl acrylate, lauryl methacrylate, stearyl acrylate, stearyl methacrylate, cyclic trimethylolpropane formal acrylate, 2-[[(Butylamino) carbonyl] oxy]ethyl acrylate (e.g. Genomer 1122 from RAHN USA Corporation), 3,3,5-trimethylcyclohexane acrylate, or mono-functional methoxylated PEG (350) acrylate. Multifunctional monomers include diacrylates or dimethacrylates of diols and polyether diols, such as propoxylated neopentyl glycol diacrylate, 1,6-hexanediol diacrylate, 1,6-hexanediol dimethacrylate, 1,3-butylene glycol diacrylate, 1,3-butylene glycol dimethacrylate 1,4-butanediol diacrylate, 1,4-butanediol dimethacrylate, alkoxylated aliphatic diacrylate (e.g., SR9209A from Sartomer®), diethylene glycol diacrylate, diethylene glycol dimethacrylate, dipropylene glycol diacrylate, tripropylene glycol diacrylate, triethylene glycol dimethacrylate, alkoxylated hexanediol diacrylates, or combinations thereof, for example SR562, SR563, SR564 from Sartomer®.

Examples of reactive diluents include monoacrylate, 2-ethylhexyl acrylate, octyldecyl acrylate, cyclic trimethylolpropane formal acrylate, caprolactone acrylate, isobornyl acrylate (IBOA), or alkoxylated lauryl methacrylate.

In some embodiments, the first and/or second precursor compositions 363 and 373 further comprise one or more photoinitiators. Photoinitiators used herein include polymeric photoinitiators and/or oligomer photoinitiators, such as benzoin ethers, benzyl ketals, acetyl phenones, alkyl phenones, phosphine oxides, benzophenone compounds and thioxanthone compounds that include an amine synergist, combinations thereof, and equivalents thereof. For example, in some embodiments photoinitiators include Irgacure® products manufactured by BASF of Ludwigshafen, Germany, or equivalent compositions.

Herein, the third precursor composition 383 comprises a water-soluble polymer, a water-soluble inert material, a water-containing hydrophilic polymer, a hydrophilic polymerizable monomer in water, and combinations thereof and abrasive particles, including silica, aluminum oxide, aluminum silicate ceramic, cerium oxide, silicon carbide, titanium dioxide, alumina-zirconia, and combinations thereof.

Examples of water soluble polymers, such as hydrogels, include 1-vinyl-2-pyrrolidone, vinylimidazole, polyethylene glycol diacrylate, acrylic acid, sodium styrenesulfonate, Hitenol BC10®, Maxemul 6106®, hydroxyethyl acrylate and [2-(methacryloyloxy)ethyltrimethylammonium chloride, 3-allyloxy-2-hydroxy-1-propanesulfonic acid sodium, sodium 4-vinylbenzenesulfonate, [2-(methacryloyloxy) ethyl]dimethyl-(3-sulfopropyl)ammonium hydroxide, 2-acrylamido-2-methyl-1-propanesulfonic acid, vinylphosphonic acid, allyltriphenylphosphonium chloride, (vinylbenzyl)trimethylammonium chloride, allyltriphenylphosphonium chloride, (vinylbenzyl)trimethylammonium chloride, E-SPERSE® RS-1618, E-SPERSE® RS-1596, Methoxy Polyethylene Glycol Monoacrylate, Methoxy Polyethylene Glycol Diacrylate, Methoxy Polyethylene Glycol Triacrylate, combinations thereof, and equivalents thereof, where E-SPERSE products are available from Ethox Chemicals, LLC in Greenville, S.C.

Examples of water soluble inert materials include glycols (e.g., polyethylene glycols), glycol-ethers, and amines. In one embodiment, the water-soluble inert material is selected from the group comprising ethylene glycol, butanediol, dimer diol, propylene glycol-(1,2) and propylene glycol-(1,3), octane-1,8-diol, neopentyl glycol, cyclohexane dimethanol (1,4-bis-hydroxymethylcyclohexane), 2-methyl-1,3-propane diol, glycerine, trimethylolpropane, hexanediol-(1,6), hexanetriol-(1,2,6) butane triol-(1,2,4), trimethylolethane, pentaerythritol, quinitol, mannitol and sorbitol, methylglycoside, also diethylene glycol (DEG), triethylene glycol, tetraethylene glycol, polyethylene glycols, dibutylene glycol, polybutylene glycols, ethylene glycol, ethylene glycol monobutyl ether (EGMBE), diethylene glycol monoethyl ether, ethanolamine, diethanolamine (DEA), triethanolamine (TEA), and combinations thereof.

Examples of water-containing hydrophilic polymers include vinyl polymers such as polyvinyl alcohol, polyvinylpyrrolidone (PVP) and polyvinyl methyl ether.

Examples of hydrophilic polymerizable monomers include triethanolamine (TEA) surfactant, polyoxyethylene alkyl phenyl ether ammonium sulfates, polyoxyethylene alkyl phenyl ethers, anionic phosphate esters, and combinations thereof. In one embodiments, the water-containing hydrophilic polymers are selected from Hitenol™ (polyoxyethylene alkyl phenyl ether ammonium sulfate) and Noigen™ (polyoxyethylene alkyl phenyl ether) surfactants commercially available from Dai-lchi Kogyo Seiyaku Co., Ltd. of Japan; and the Maxemul™ (anionic phosphate ester) surfactants commercially available from Uniqema of The Netherlands. Suitable grades of some of the materials listed above may include Hitenol BC-10™, Hitenol BC-20™, Hitenol BC-30™, Noigen RN-10™, Noigen RN-20™, Noigen RN-30™, Noigen RN-40™, and Maxemul 6106™, which has both phosphonate ester and ethoxy hydrophilicity, a nominal $C_{18}$ alkyl chain with an acrylate reactive group, and 6112™.

In some embodiments, the third precursor composition 383 comprises poly(lactic-co-glycolic acid) (PLGA).

In some embodiments, the third precursor composition 383 further includes one or more of the first precursor composition 363, a diluent, a photoinitiator, and a dispersion and/or suspension agent. Dispersion and/or suspension agents are typically used to stabilize the abrasive particles within a liquid suspension, for example by increasing the electrostatic repulsion (zeta potential) between abrasive particles. Dispersion and/or suspension agents can be used to enable a homogenous suspension of the abrasive particles in the liquid of a precursor compositions, such as the third precursor composition 383. Examples of dispersion and/or suspension agents include Hyper® products, such as HypermerKD4 and Hyper KD57, available from Croda, Inc., of New Castle, Del., USA, or BYK Dis2008 or BYK9152 available from BYK-Gardner GmbH of Germany.

In one exemplary embodiment, the third precursor composition 383 comprises diacrylate, diethylene glycol (DEG), and ceria, where a ratio of diacrylate to DEG by weight is less than about 1:5 and the concentration of ceria is between about 0.1% and about 90 wt. %.

In some embodiments, the third precursor 383 is milled using a probe sonicator to break up larger agglomerations of abrasive particles into smaller agglomerations, and or individual particles, having a mean diameter between about 30 nm and about 300 nm. In other embodiments, other types of milling processes, for example ball milling, are used to reduce larger agglomerations of abrasive particles to desirable sizes either before, during, or after mixing of the precursor.

In some embodiments, the abrasive particles are treated with a surface modifying organic compound to functionalize the surfaces thereof. Herein, the functionalized abrasive particles comprise at least one polymerizable group chemically bonded to bonding sites on the surfaces thereof. Surface modifying organic compounds herein include organic silane compounds, sulfonic acid compounds, organic phosphoric acid compounds, carboxylic acid compounds, derivatives thereof, or combinations thereof. Examples of organic silane compounds include alkoxy silane, such as trichloro(phenyl)silane, trichloro(hexyl)silane, trichloro(octadecyl)silane, trimethoxy(7-octen-1-yl)silane, trichloro[2-(chloromethyl)allyl]silane, vinyltrimethoxysilane, chloro(dimethyl)vinylsilane, allyltrimethoxysilane, acryloyl chloride, vinyltrimethoxysilane, or combinations thereof. Examples of cyanate compounds include isocyanate based monomers such as tris-[3-(trimethoxysilyl)propyl] isocyanurate or 2-(methacryloyloxy)ethyl isocyanate. Examples of sulfonic or phosphoric acid derivatives include 2-acrylamido-2-methyl-1-propanesulfonic acid or vinyl phosphonate. For some CMP processes, excessive loading (% of polymerizable group terminated bonding sites on surfaces of the abrasive particles) will undesirably influence the mechanical and/or chemical interaction of the abrasive particles with the material surfaces of the substrate 110. Therefore, in some embodiments, it is desirable to limit the loading of functionalized surface sites on the abrasive particles to not more than about 5%.

Typically, layers formed of the droplets of the precursor compositions 363, 373, and 383 dispensed by the dispensing heads 360, 370, 380, and 390 are cured by exposure to radiation 321 from a radiation source 320, such as a visible light source, an ultraviolet light (UV) source, x-ray source, or other type of electromagnetic wave source. Herein, the radiation 321 is UV radiation provided by a UV source. In other embodiments, the precursor compositions 363, 373, and/or 383 are cured by exposure to thermal energy.

Figures 3B, 3C:
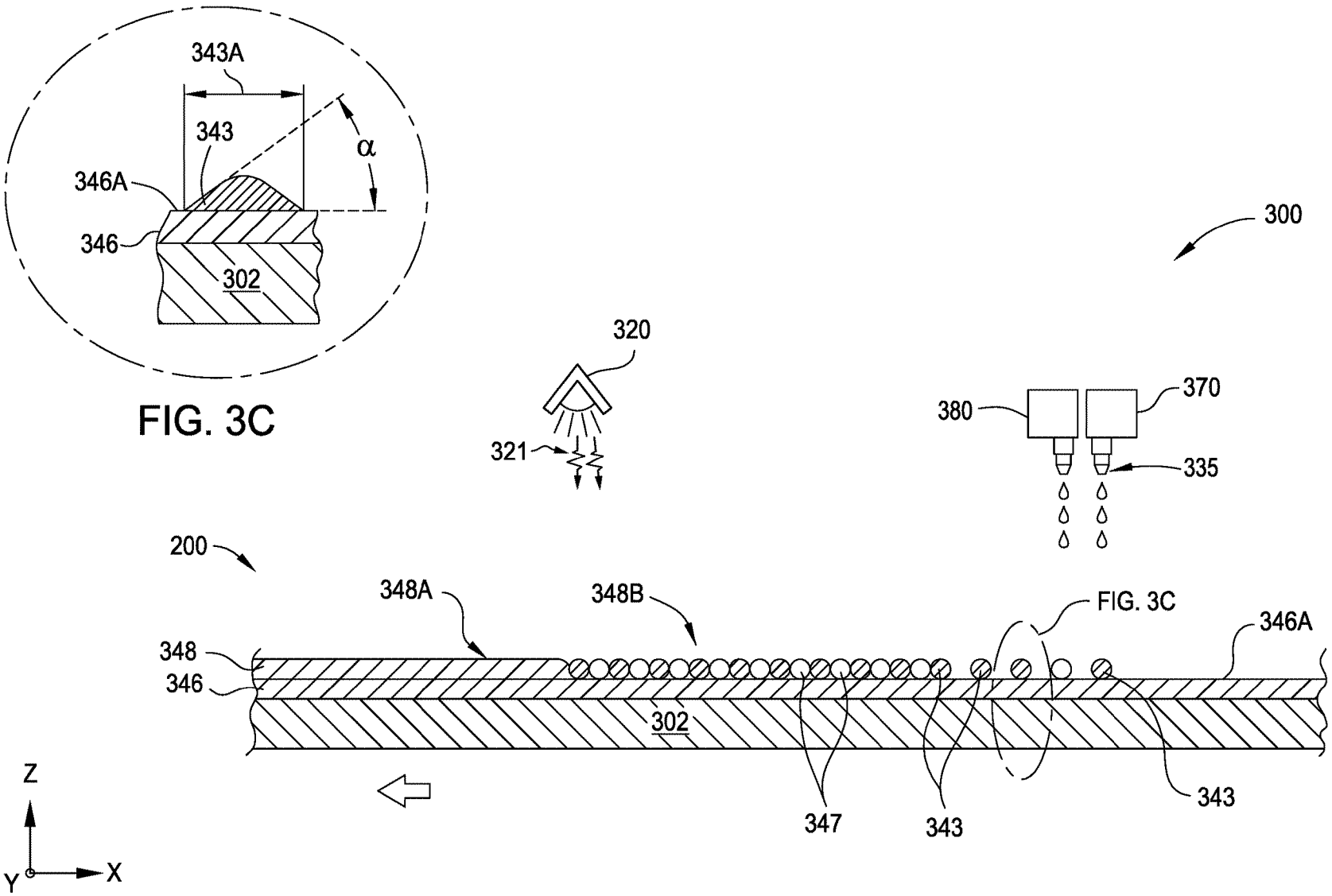
FIGS. 3B and 3C illustrate a curing process using the additive manufacturing system of FIG. 3A.

FIGS. 3B and 3C illustrate a curing process using the additive manufacturing system 300. FIG. 3B shows a portion of one or more previously formed layers 346 of a polishing element, such as polishing element 204*a*, 204*b*. During processing, the dispensing heads, for example dispensing heads 370 and 380, deliver a plurality of droplets 343 and 347 of one or more precursor compositions, such as the second precursor composition 373 and the third precursor composition 383, to a surface 346A of the one or more first layers 346. As used herein, the term "curing" includes partially curing the droplets to form a desired layer, as complete curing of the droplets may limit desirable reactions with droplets of subsequently deposited layers. The plurality of droplets 343 and 347 form one of a plurality of second layers 348 which, in FIG. 3B, includes a cured portion 348A and an uncured portion 348B where the cured portion has been exposed to radiation 321 from the radiation source 320. In embodiments herein, the cured portion comprises the reaction product of the first precursor composition 363, the reaction product of the second precursor composition 373, and/or an uncured third precursor composition 383, partially cured third precursor composition 383, and/or the reaction product of the third precursor composition 383. Herein, the thickness of the cured portion 348A of the first layer is between about 0.1 micron and about 1 mm, such as between about 5 microns and about 100 microns, for example between about 25 microns and about 30 microns.

FIG. 3C is a close up cross-sectional view of a droplet 343 dispensed onto the surface 346A of the one or more previously formed layers 346. As shown in FIG. 3C, once dispensed onto the surface 346A, the droplet 343 spreads to a droplet diameter 343A having a contact angle α. The droplet diameter 343A and contact angle α are a function of at least the material properties of the precursor composition, the energy at the surface 346A (surface energy) of the one or more previously formed layers 346, and time. In some embodiments, the droplet diameter 343A and the contact angle α will reach an equilibrium after a short amount of time, for example less than about one second, from the moment that the droplet contacts the surface 346A of the one or more previously formed layers 346. In some embodiments, the droplets 343 are cured before reaching an equilibrium droplet diameter and contact angle α. Typically, the droplets 343 have a diameter of between about 10 and about 200 micron, such as between about 50 micron and about 70 microns before contact with the surface 346A and spread to between about 10 and about 500 micron, between about 50 and about 200 microns, after contact therewith.

Herein, the precursor compositions 363, 373 and 383 are formulated to have a viscosity between about 80 cP and about 110 cP at about 25° C., between about 15 cP and about 30 cP at about 70° C., or between 10 cP and about 40 cP for temperatures between about 50° C. and about 150° C. so that the mixtures may be effectively dispensed through the nozzles 335 of the dispensing heads 360, 370, 380, and 390. In other embodiments, the third precursor composition has a viscosity of less than about 80 cP at 25° C. and less than about 15 cP at 70° C. In some embodiments, the third precursor composition 383 is recirculated or otherwise mechanically agitated to ensure that the abrasive particles remain suspended therein. In some embodiments, the contact angle α of droplets the third precursor 383 on the surface 346A of the previously formed layers 346 is sufficiently large to enable desirable resolution of the abrasive delivery features 217. In some of those embodiments, the third precursor 383 is formulated to form droplets having a contact angle α that is greater than 50°, such as greater than 55°, greater than 60°, greater than 70°, or even greater than 80°. However, in other embodiments, the wetting properties of droplets of the third precursor 383 on the surface 346A of the one or more previously formed layers 346 are not compatible with forming high resolution features as they result in an undesirably small contact angle α, in those embodiments, the method disclosed in FIG. 4A-4D is used to form wells into which droplets of the third precursor 383 are dispensed.

Figure 4A:
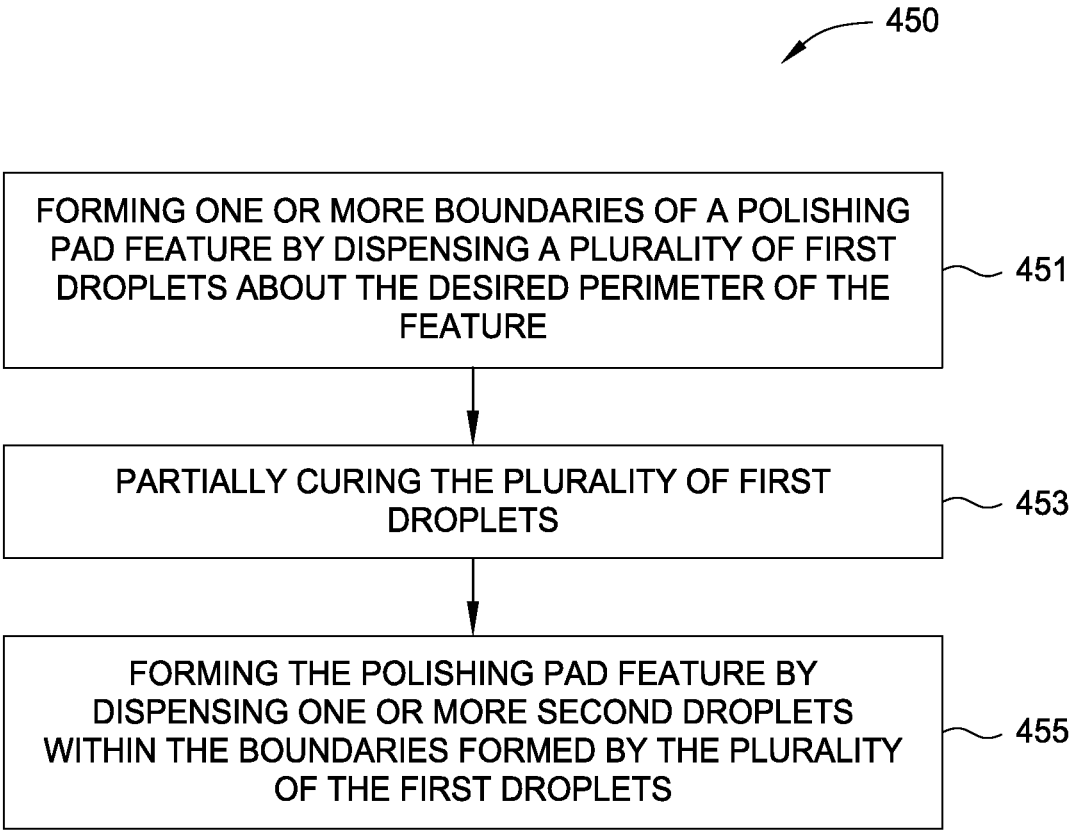
FIG. 4A is a flow diagram of a method of forming an abrasive delivery feature, according to some embodiments.
Figure 4B:
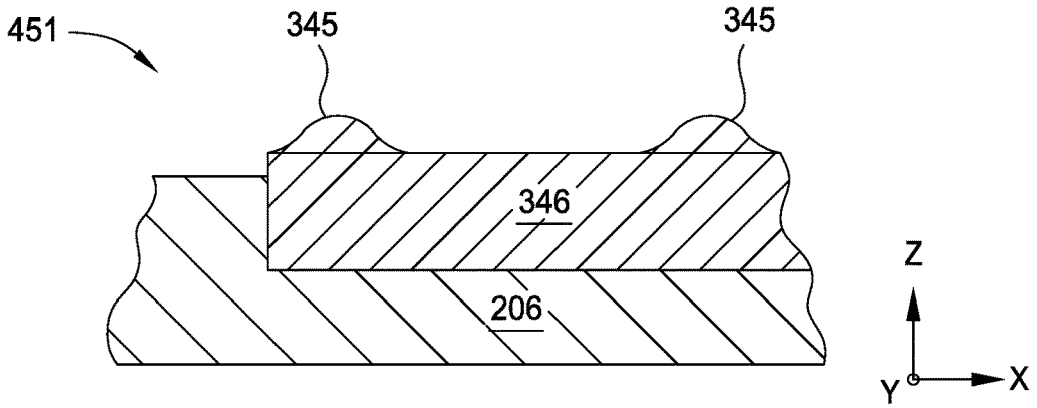
FIGS. 4B-4D illustrate the method shown in FIG. 4.
Figure 4C:
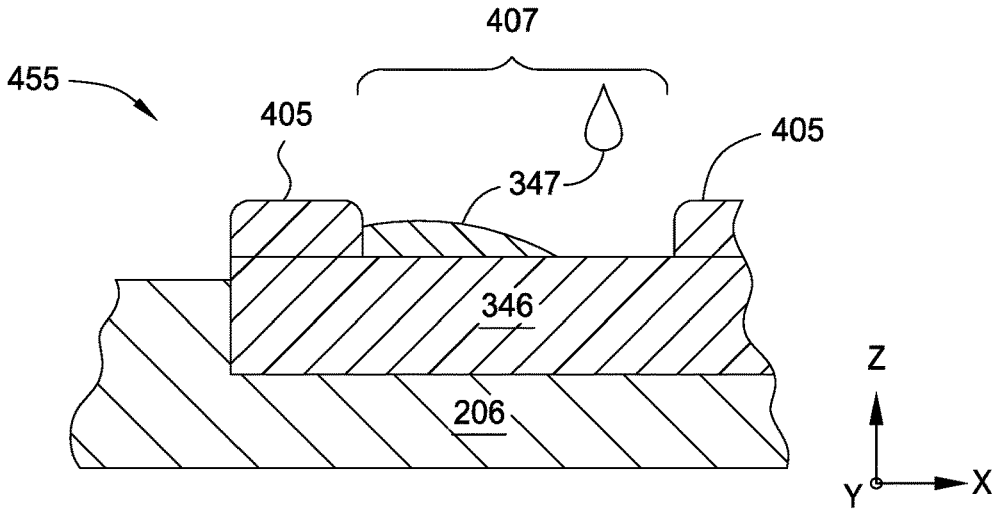
Figure 4D:
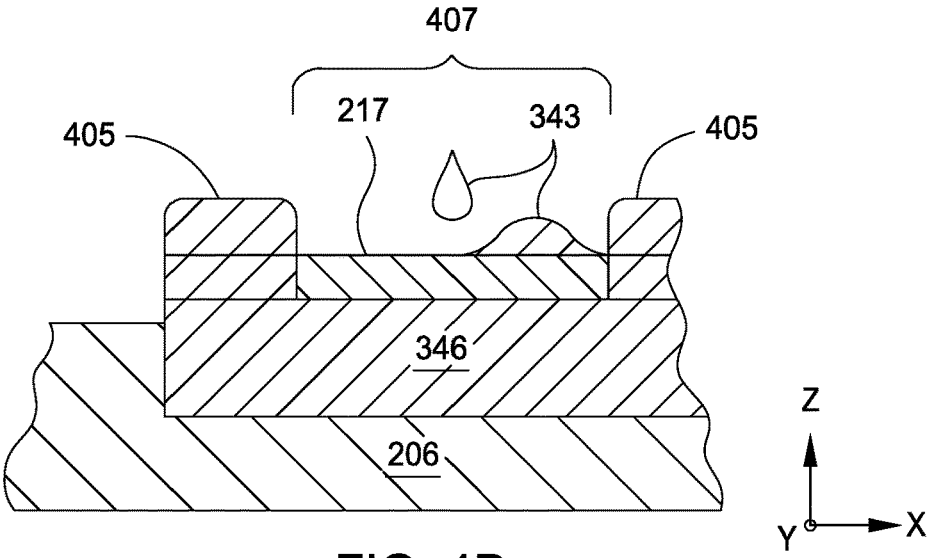

FIG. 4A is a flow diagram of a method 450 of forming an abrasive delivery feature 217 using a curable resin precursor, such as the second precursor 373, to serve as vertical boundaries of the abrasive delivery feature 217, according to some embodiments. FIGS. 4B-4D illustrate the method 450. The method 450 begins at activity 451 with the forming of one or more boundaries of a polishing pad feature, such as the abrasive delivery feature 217 shown in FIGS. 2C and 2D, by dispensing a plurality of boundary droplets 345 about a desired perimeter of the feature. Typically, the boundary droplets 345 are formed of a curable resin precursor, such as in FIG. 4B where the boundary droplets 345 are formed from the second precursor composition 373 disclosed above. The second precursor composition 373 is formulated to control the wetting properties, and thus the contact angle, of the dispensed boundary droplets 345 on the surface 346A on the one or more previously formed layers 346, using embodiments disclosed herein. The contact angle α of the boundary droplets 345 is large enough that the dispensed boundary droplets 345 form substantially vertical sidewalls of the abrasive delivery feature 217. In some embodiments, the contact angle α of a fixed boundary droplet 345 has a value of greater than 50°, such as greater than 55°, greater than 60°, greater than 70°, or even greater than 80°.

The method 450 continues at activity 453 with the partial curing of the plurality of boundary droplets 345 of the curable resin precursor. Herein, the boundary droplets 345 of the curable resin precursor are partially cured by a curing device after the deposition of a layer of the boundary droplets 345. Partially curing the boundary droplets 345 after each layer is formed allows for the boundary droplets 345 to be fixed so they do not move or change their shape as subsequent boundary droplets 345 are deposited upon them. Partially curing the boundary droplets 345 also allows for control of the surface energy of the layer, and thus control of the contact angle α of subsequently deposited droplets. In some embodiments activities 451 and 453 are repeated until a desired height of the boundaries, such as the boundary walls 405 in FIGS. 4C and 4D is reached. In some embodiments, further control of the contact angle α is achieved by partially curing each of the boundary droplets 345 before each of the boundary droplets 345 spreads to its equilibrium size and contact angle. In other embodiments, the curable resin precursor is formulated so that the droplets become fixed in place without partial curing thereof.

The method 450 continues at activity 453, with the forming of the abrasive delivery feature 217 by dispensing one or more abrasive feature precursor droplets 347, such as the third precursor 283 disclosed in FIG. 2A, within the boundary walls 405 formed by the plurality of boundary droplets 345. The boundary walls 405 formed at 451 and 453 from the boundary droplets 345 form a well, such as the well volume 407 defined by boundary walls 405 shown in FIGS.

4C and 4D, that captures, holds or retains subsequently deposited abrasive feature precursor droplets 347. The well volume 407 allows for droplet formulations with high wetting properties and low contact angles to be dispensed without negatively impacting the resolution of the printed abrasive delivery features 217 due to the "wetting" or spreading out of the material found in the abrasive feature precursor formulation across the underlying surface. In some embodiments, the abrasive feature precursor droplets 347 wet the surface 346A of the one or more previously formed layers 346 and spread to fill the well volume 407. In those embodiments, the well volume 407 is filled with the abrasive feature precursor droplets 347 so that the resulting abrasive delivery feature 217 is level with the boundary walls 405 before additional layers of curable resin precursors are deposited across the surface of both the boundary walls 405 and the abrasive delivery feature 217. In other embodiments not shown the well volume 407 is partially filled so that the boundary walls 405 extend around and extend above the level of the abrasive delivery feature 217. A plurality of boundary droplets 345 is then deposited on the abrasive delivery feature 217 until the well volume 407 is filled to the level of the boundary walls 405 in order to "cap" the well. Capping the well in this manner may be beneficial where the contact angle $\alpha$ of the dispensed boundary droplets 345 on the surface of abrasive delivery feature 217 would negatively impact the printing resolution of subsequent layers.

Benefits of abrasive delivery features formed according to the methods disclosed herein are repeatable, and allow for precise dimensions of abrasive delivery features, and precise locating of the abrasive delivery feature locations, within the polishing pad allowing for increased tunability of polishing pad performance. In addition, the method 450 allows for formation of high resolution vertical structures using droplets of precursor formulations that are otherwise incompatible with 3D printing in a vertical direction.

Figure 5:
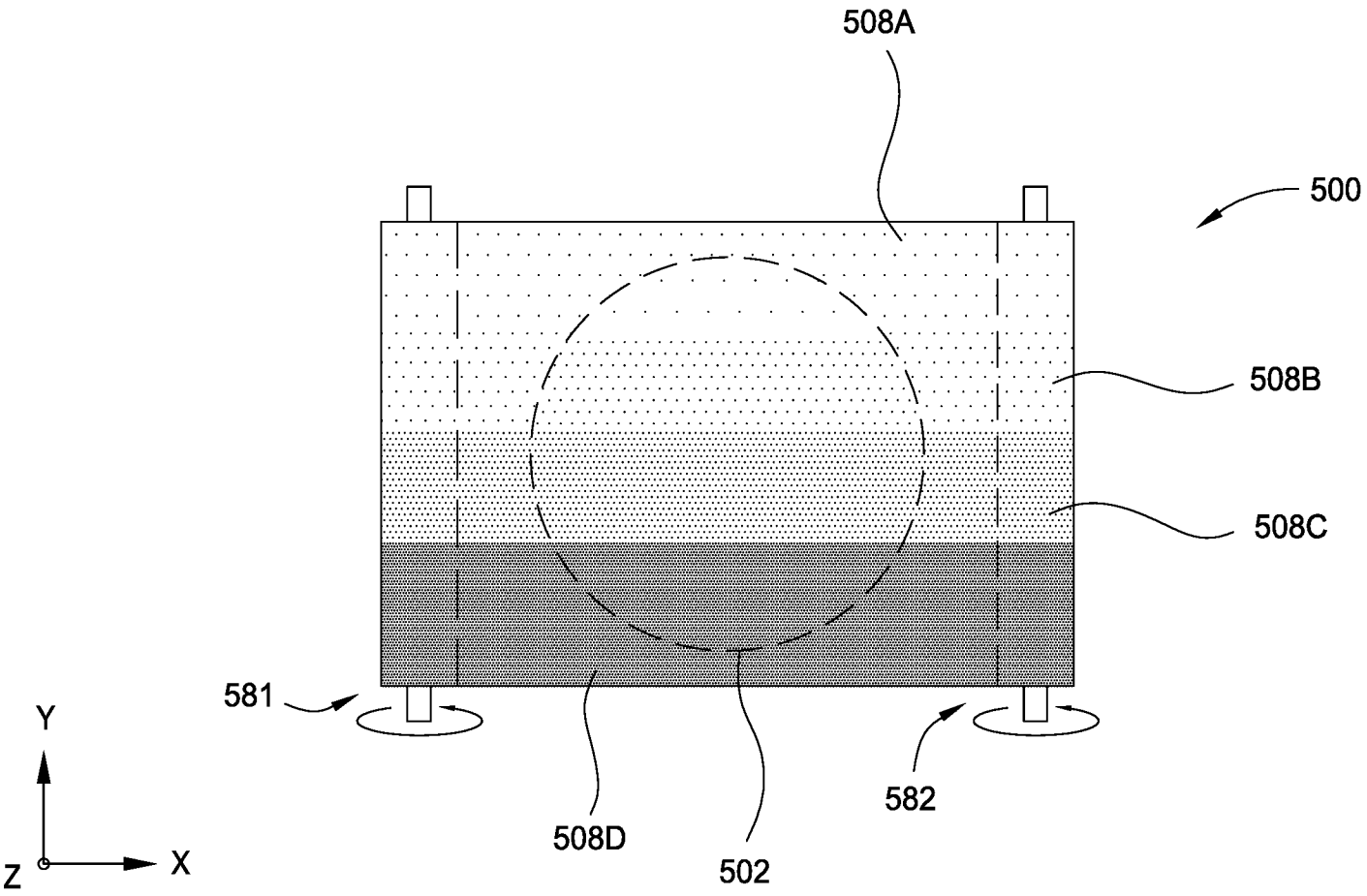
FIG. 5 is a schematic top view of an abrasive delivery (AD) polishing pad used with web based or roll-to-roll type polishing system, formed according to embodiments described herein.

FIG. 5 is a schematic top view of an abrasive delivery (AD) polishing pad 500 used with web based or roll-to-roll type polishing systems. The AD polishing pad 500 is formed using an additive manufacturing system, such as the additive manufacturing system 300 shown in FIGS. 3A-3B. Herein, a portion of the AD polishing pad 500 is disposed over a polishing platen 502 between a first roll 581 and a second roll 582. The AD polishing pad 500 comprises a concentration gradient of abrasive particles bonded to the polishing pad material thereof across the polishing surface 508 thereof. Herein, the AD polishing pad 500 has a first region 508A comprising a low density of abrasive delivery features and/or low concentrations of abrasive particles in the support material of the abrasive delivery features, a second region 508D comprising a high density of abrasive delivery features and/or high concentrations of abrasive particles in the support material of the abrasive delivery features, and intermediate regions 508B, 508C comprising an intermediate density of abrasive delivery features and/or intermediate concentrations of abrasive particles in the support material of the abrasive delivery features. In some embodiments, the regions 508A-D are formed according to embodiments herein from a plurality of precursor compositions, each comprising a different concentration of abrasive particles. In other embodiments, regions of varying concentrations of abrasive particles are formed by alternating droplets of a precursor composition comprising a high concentration of abrasive particles with a precursor composition comprising a low concentration of abrasive particles or with a precursor composition comprising no abrasive particles.

Figure 6:
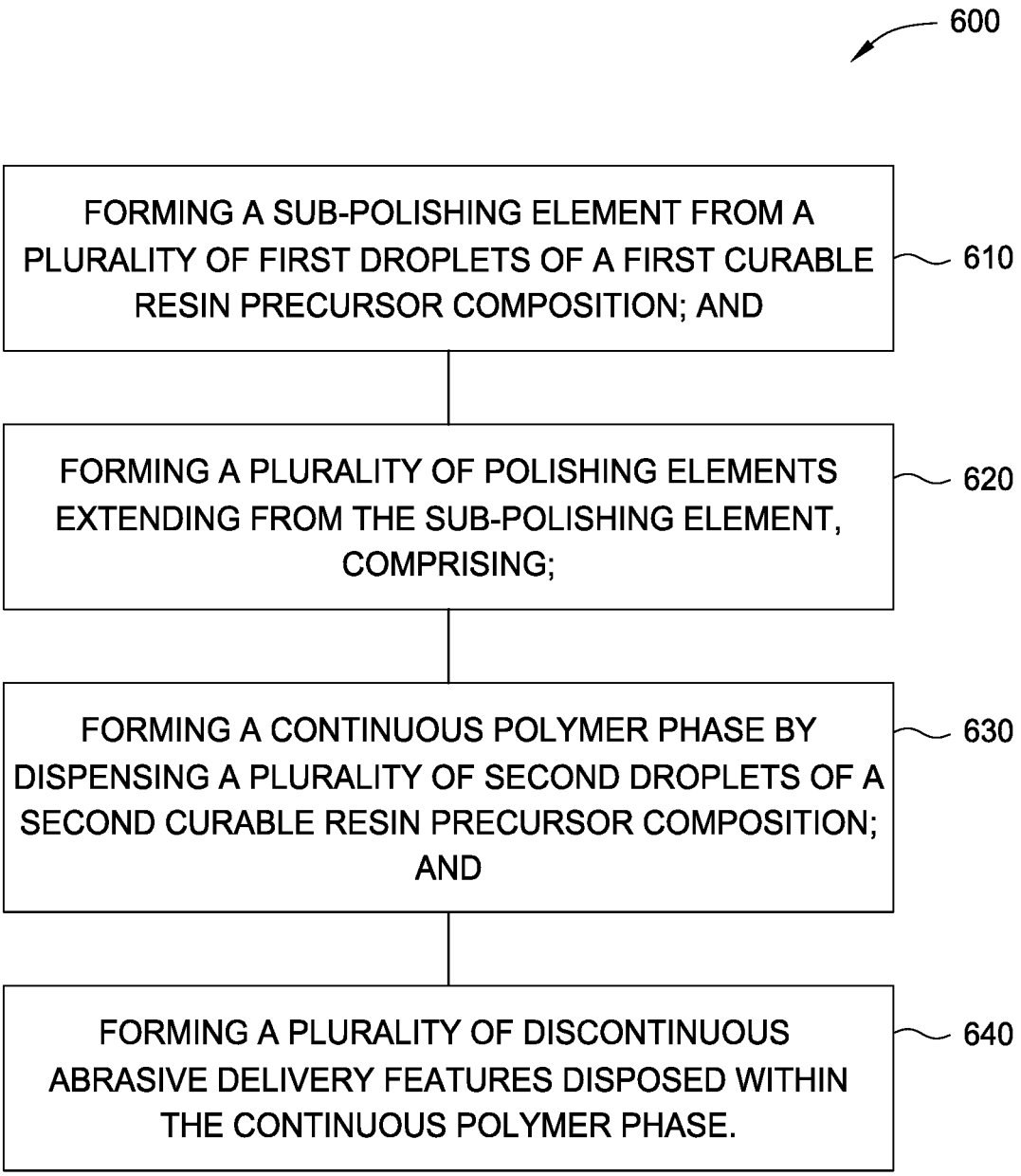
FIG. 6 is a flow diagram illustrating a method of forming an abrasive deliver (AD) polishing pad, according to embodiments described herein.

FIG. 6 is a flow diagram illustrating a method 600 of forming a polishing pad, such as the abrasive delivery (AD) polishing pads 200*a*, 200*b* of FIG. 2A-2B, according to embodiments described herein.

The method 600 begins at activity 610 by forming a sub-polishing element from a plurality of first droplets of a first curable resin precursor composition, such as the first precursor composition 363 described in FIGS. 3A-3C.

The method 600 continues at activity 620 with forming a plurality of polishing elements, extending from the sub-polishing element, comprising activities 630 and 640. Activity 620 comprises forming a continuous polymer phase by dispending a plurality of second droplets of a second curable resin precursor composition, such as the second precursor composition described in FIGS. 3A-3C. Herein, the first curable resin precursor composition and the second curable resin precursor composition each comprise a mixture of one or more functional polymers, functional oligomers, monomers, and/or reactive diluents. In some embodiments, the first curable resin precursor composition and the second curable resin precursor composition each further comprises one or more photoinitiators.

Activity 640 comprises forming a plurality of discontinuous abrasive delivery features disposed within the continuous polymer phase of the plurality of polishing elements by dispensing one or more droplets of a water soluble precursor composition, the water soluble precursor composition comprising abrasive particles interspersed therein. Herein, the water soluble precursor composition further comprises a water soluble material selected from the group consisting of water soluble polymers, water soluble inert materials, hydrophilic polymers, hydrophilic polymerizable monomers, and combinations thereof. In some embodiments the abrasive particles are selected from the group consisting of silica, aluminum oxide, aluminum silicate ceramic, cerium oxide, silicon carbide, titanium dioxide, alumina-zirconia, and combinations thereof.

In some embodiments, forming the plurality of discontinuous abrasive delivery features comprises dispensing one or more of the plurality of second droplets of the second curable resin precursor composition to form a plurality of polymer layers, wherein one or more of the plurality of the droplets of the second curable resin precursor composition are dispensed to form walls of the polymer layers before one or more droplets of the water soluble precursor composition are dispensed to form an interior of the polymer layers, as described in FIG. 4.

In some embodiments, the water soluble precursor composition is milled before dispensing the one or more third droplets so that the abrasive particles, or agglomerations thereof, have a mean diameter of between about 10 nm and about 300 nm. In embodiments herein, forming the sub-polishing element and forming the plurality of polishing elements comprises exposing the plurality of first droplets and the plurality of second droplets to UV radiation.

The method 600 enables the formation of a polishing pad capable of providing and/or delivering abrasive particles to a polishing interface of the polishing pad surface and a material surface of a substrate through precise location and sizing of water soluble abrasive delivery features and a high resolution thereof.

While the foregoing is directed to embodiments of the present disclosure, other and further embodiments of the disclosure may be devised without departing from the basic scope thereof, and the scope thereof is determined by the claims that follow.

The invention claimed is:

1. A polishing article, comprising:
a sub-polishing element comprising a first continuous polymer phase; and
a plurality of polishing elements extending from the sub-polishing element, each of the plurality of polishing elements comprising:
a second continuous polymer phase; and
a plurality of abrasive particle delivery features disposed in the second continuous polymer phase, wherein each of the abrasive particle delivery features comprises a water soluble support material having a plurality of abrasive particles interspersed therein.

2. The polishing article of claim 1, wherein the plurality of abrasive particle delivery features have an average width of between 1 μm and about 500 μm.

3. The polishing article of claim 2, wherein the abrasive particles interspersed in the plurality of abrasive particle delivery features have a mean diameter of between about 30 nm and about 300 nm.

4. The polishing article of claim 1, wherein the water soluble material is selected from the group consisting of water soluble polymers, water soluble inert materials, hydrophilic polymers, hydrophilic polymerizable monomers, and combinations thereof.

5. The polishing article of claim 4, wherein the abrasive particles are selected from the group consisting of silica, aluminum oxide, aluminum silicate ceramic, cerium oxide, silicon carbide, titanium dioxide, alumina-zirconia, and combinations thereof.

6. The polishing article of claim 1, wherein the plurality of polishing elements have a first storage modulus that is more than about 100 MPa at 30° C.

7. The polishing article of claim 6, wherein the sub-polishing element has a second storage modulus that is less than about 500 MPa at 30° C., and wherein the second storage modulus is less than the first storage modulus.

8. The polishing article of claim 1, wherein polymers in the subpolishing element and in the plurality of polishing elements are chemically bonded at interfaces thereof.

9. The polishing article of claim 8, wherein portions of the plurality of polishing elements are disposed in the sub-polishing element.

10. The polishing article of claim 8, wherein the first continuous polymer phase is formed from a first precursor composition and the second continuous polymer phase is formed from a second precursor composition and interfaces of one or more of the plurality of polishing elements and the sub-polishing element comprises a reaction product of the first precursor composition and the second precursor composition.

11. A polishing article, comprising:
a sub-polishing element comprising a first reaction product of a plurality of first droplets of a first precursor composition;
a plurality of polishing elements extending from the sub-polishing element comprising a second reaction product of a plurality of droplets of a second precursor composition;
a plurality of discontinuous abrasive delivery features disposed in each of one or more of the plurality of polishing elements, each of the abrasive delivery features comprising a water soluble support material having abrasive particles interspersed therein; and
a plurality of interfaces coupling the sub-polishing element to the plurality of polishing elements, wherein one or more of the plurality of interfaces comprises a third reaction product of the first precursor composition and the second precursor composition.

12. The polishing article of claim 11, wherein portions of the plurality of polishing elements are disposed in the sub-polishing element.

13. The polishing article of claim 11, wherein the plurality of abrasive particle delivery features each have an average width of between 1 μm and about 500 μm and the abrasive particles interspersed in the plurality of abrasive particle delivery features have a mean diameter of between about 30 nm and about 300 nm.

* * * * *